US011036180B2

(12) United States Patent
Sato

(10) Patent No.: US 11,036,180 B2
(45) Date of Patent: Jun. 15, 2021

(54) IMAGE FORMING APPARATUS WITH SIDE FRAMES

(71) Applicant: Brother Kogyo Kabushiki Kaisha, Nagoya (JP)

(72) Inventor: Shougo Sato, Seto (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 0 days.

(21) Appl. No.: 16/823,051

(22) Filed: Mar. 18, 2020

(65) Prior Publication Data

US 2020/0218197 A1 Jul. 9, 2020

Related U.S. Application Data

(63) Continuation of application No. 15/643,985, filed on Jul. 7, 2017, now Pat. No. 10,627,779, which is a (Continued)

(30) Foreign Application Priority Data

Feb. 6, 2015 (JP) ..... 2015-022594

(51) Int. Cl.
*G03G 21/18* (2006.01)

(52) U.S. Cl.
CPC ..... *G03G 21/1853* (2013.01); *G03G 21/1842* (2013.01); *G03G 21/1857* (2013.01); (Continued)

(58) Field of Classification Search
CPC ..... G03G 21/1853; G03G 21/1842; G03G 21/1871; G03G 21/1864
See application file for complete search history.

(56) References Cited

U.S. PATENT DOCUMENTS 5,065,197 A 11/1991 Mitsuyama
5,225,881 A 7/1993 Goto et al.
(Continued)

FOREIGN PATENT DOCUMENTS

BR 102012028057 A2 6/2015
CN 101614996 A 12/2009
(Continued)

OTHER PUBLICATIONS

Jun. 12, 2020—U.S. Notice of Allowance—U.S. Appl. No. 16/785,736.
(Continued)

*Primary Examiner* — Arlene Heredia
(74) *Attorney, Agent, or Firm* — Banner & Witcoff, Ltd.

(57) ABSTRACT

An image forming apparatus includes a main body including a first guide portion and a second guide portion, a process cartridge including a photosensitive drum, a support frame configured to support the process cartridge and move between an inside position and an outside position. The support frame includes a first side frame. The first side frame includes a first guided portion to be guided by the first guide portion. The second side frame includes a second guided portion guided by the second guide portion A dimension of the first side frame is greater than or equal to a dimension of the first side frame. A dimension of the second side frame is greater than or equal to a dimension of the second side frame.

20 Claims, 18 Drawing Sheets

Related U.S. Application Data continuation of application No. 15/015,323, filed on Feb. 4, 2016, now Pat. No. 9,772,603.

(52) U.S. Cl.
CPC ..... *G03G 21/1867* (2013.01); *G03G 21/1864* (2013.01); *G03G 21/1871* (2013.01)

(56) References Cited

U.S. PATENT DOCUMENTS

| | | | |
|---|---|---|---|
| 6,587,660 | B2 | 7/2003 | Ueno et al. |
| 7,426,355 | B2 | 9/2008 | Okabe |
| 7,486,907 | B2 | 2/2009 | Noguchi et al. |
| 7,660,549 | B2 | 2/2010 | Noguchi et al. |
| 7,664,428 | B2 | 2/2010 | Kei |
| 7,684,728 | B2 | 3/2010 | Okabe et al. |
| 8,145,095 | B2 | 3/2012 | Sakurai et al. |
| 8,358,952 | B2 | 1/2013 | Okabe |
| 8,369,743 | B2 | 2/2013 | Maeshima et al. |
| 8,447,208 | B2 | 5/2013 | Fujita et al. |
| 8,452,208 | B2 | 5/2013 | Kikuchi |
| 8,463,156 | B2 | 6/2013 | Akutsu et al. |
| 8,526,848 | B2 | 9/2013 | Nishiuwatoko et al. |
| 8,606,143 | B2 | 12/2013 | Kikuchi |
| 8,712,282 | B2 | 4/2014 | Sato |
| 8,755,718 | B2 | 6/2014 | Ushiozu et al. |
| 8,768,206 | B2 | 7/2014 | Sato |
| 8,768,212 | B2 | 7/2014 | Hashimoto et al. |
| 8,792,805 | B2 | 7/2014 | Takayama |
| 8,855,518 | B2 | 10/2014 | Eom |
| 8,855,530 | B2 | 10/2014 | Sato |
| 8,855,531 | B2 | 10/2014 | Suzuki et al. |
| 8,862,022 | B2 | 10/2014 | Sato et al. |
| 8,892,002 | B2 | 11/2014 | Sato |
| 8,929,770 | B2 | 1/2015 | Sato |
| 8,948,656 | B2 | 2/2015 | Nakano |
| 9,037,036 | B2 | 5/2015 | Yamashita et al. |
| 9,052,688 | B2 | 6/2015 | Sekido |
| 9,075,331 | B2 | 7/2015 | Hashimoto et al. |
| 9,128,459 | B2 | 9/2015 | Souda |
| 9,134,686 | B2 | 9/2015 | Yoshikawa et al. |
| 9,134,695 | B2 | 9/2015 | Furukawa et al. |
| 9,146,492 | B2 | 9/2015 | Suzuki |
| 9,146,531 | B2 | 9/2015 | Sato |
| 9,274,501 | B2 | 3/2016 | Okabe |
| 2006/0067734 | A1 | 3/2006 | Igarashi et al. |
| 2007/0077087 | A1 | 4/2007 | Okabe et al. |
| 2007/0160385 | A1 | 7/2007 | Noguchi et al. |
| 2008/0159774 | A1* | 7/2008 | Tanabe ..... G03G 21/1842 399/90 |
| 2009/0047039 | A1 | 2/2009 | Noguchi et al. |
| 2009/0092412 | A1 | 4/2009 | Kei |
| 2009/0116869 | A1 | 5/2009 | Kotsuka et al. |
| 2009/0245859 | A1 | 10/2009 | Okabe |
| 2009/0290903 | A1 | 11/2009 | Horikawa et al. |
| 2009/0290904 | A1 | 11/2009 | Kawai et al. |
| 2009/0290905 | A1 | 11/2009 | Mizuno et al. |
| 2009/0324275 | A1 | 12/2009 | Okabe |
| 2010/0080615 | A1 | 4/2010 | Kikuchi |
| 2010/0080619 | A1 | 4/2010 | Kawanami |
| 2010/0080623 | A1 | 4/2010 | Tanaka et al. |
| 2010/0111562 | A1 | 5/2010 | Okabe et al. |
| 2010/0124432 | A1 | 5/2010 | Takayama |
| 2010/0239314 | A1 | 9/2010 | Takayama |
| 2011/0013932 | A1 | 1/2011 | Fujita et al. |
| 2011/0217074 | A1 | 9/2011 | Kawanami |
| 2012/0003005 | A1 | 1/2012 | Nishiuwatoko |
| 2012/0057900 | A1 | 3/2012 | Okabe |
| 2012/0114374 | A1 | 5/2012 | Suzuki |
| 2012/0195627 | A1 | 8/2012 | Kikuchi |
| 2012/0328325 | A1 | 12/2012 | Sato |
| 2012/0328326 | A1 | 12/2012 | Sato |
| 2012/0328327 | A1 | 12/2012 | Sato |
| 2013/0108316 | A1 | 5/2013 | Sato et al. |
| 2013/0308976 | A1 | 11/2013 | Sekido |
| 2013/0315619 | A1 | 11/2013 | Shuhama et al. |
| 2014/0064782 | A1 | 3/2014 | Furukawa et al. |
| 2014/0137372 | A1 | 5/2014 | Yamashita et al. |
| 2014/0147158 | A1 | 5/2014 | Fujinaka et al. |
| 2014/0186082 | A1 | 7/2014 | Yoshikawa et al. |
| 2014/0210929 | A1 | 7/2014 | Suzuki |
| 2014/0241749 | A1 | 8/2014 | Okabe |
| 2014/0294438 | A1 | 10/2014 | Okabe |
| 2014/0308054 | A1 | 10/2014 | Okabe |
| 2014/0314446 | A1 | 10/2014 | Sato |
| 2015/0010325 | A1 | 1/2015 | Sato et al. |
| 2015/0023691 | A1 | 1/2015 | Sato |
| 2015/0071681 | A1 | 3/2015 | Sato |
| 2015/0110523 | A1 | 4/2015 | Sato |
| 2015/0227110 | A1 | 8/2015 | Yoshimura et al. |
| 2015/0261180 | A1 | 9/2015 | Sato |
| 2016/0004214 | A1 | 1/2016 | Sato |
| 2016/0026151 | A1 | 1/2016 | Sato et al. |
| 2016/0231696 | A1 | 8/2016 | Sato |
| 2016/0231700 | A1 | 8/2016 | Sato |
| 2016/0231703 | A1 | 8/2016 | Sato |

FOREIGN PATENT DOCUMENTS

| | | | |
|---|---|---|---|
| CN | 102483603 | A | 5/2012 |
| CN | 103092022 | A | 5/2013 |
| CN | 103425021 | A | 12/2013 |
| CN | 103454871 | A | 12/2013 |
| CN | 103853023 | A | 6/2014 |
| CN | 104360589 | A | 2/2015 |
| CN | 104583879 | A | 4/2015 |
| DE | 102013224071 | A1 | 5/2014 |
| EP | 2138908 | A1 | 12/2009 |
| EP | 2592496 | A2 | 5/2013 |
| EP | 2667263 | A2 | 11/2013 |
| EP | 2669746 | A2 | 12/2013 |
| GB | 2510033 | A | 7/2014 |
| GB | 2522520 | A | 7/2015 |
| JP | S63-8653 | A | 1/1988 |
| JP | H0836346 | A | 2/1996 |
| JP | H09-304994 | A | 11/1997 |
| JP | H10-245145 | A | 9/1998 |
| JP | H11-344905 | A | 12/1999 |
| JP | 2001-337580 | A | 12/2001 |
| JP | 2004-177443 | A | 6/2004 |
| JP | 2005107435 | A | 4/2005 |
| JP | 2007-101635 | A | 4/2007 |
| JP | 2009-092914 | | 4/2009 |
| JP | 2010-008724 | A | 1/2010 |
| JP | 2010-102326 | A | 5/2010 |
| JP | 2010-117731 | A | 5/2010 |
| JP | 2010-217813 | A | 9/2010 |
| JP | 2011-059730 | A | 3/2011 |
| JP | 2011-070142 | A | 4/2011 |
| JP | 2012-073656 | A | 4/2012 |
| JP | 2013-007946 | A | 1/2013 |
| JP | 2013-007947 | A | 1/2013 |
| JP | 2013-007948 | A | 1/2013 |
| JP | 2013-097185 | A | 5/2013 |
| JP | 2013-242439 | A | 12/2013 |
| JP | 2013-246366 | A | 12/2013 |
| JP | 2014-067005 | A | 4/2014 |
| JP | 2014-067010 | A | 4/2014 |
| JP | 2014-106392 | A | 6/2014 |
| JP | 2014-106393 | A | 6/2014 |
| JP | 2014-123107 | A | 7/2014 |
| JP | 2014-126842 | A | 7/2014 |
| JP | 2014167568 | A | 9/2014 |
| KR | 20120056849 | A | 6/2012 |
| KR | 20130048156 | A | 5/2013 |
| RU | 2012146552 | A | 5/2014 |
| RU | 2013123016 | A | 11/2014 |
| RU | 2014125088 | A | 12/2015 |
| TW | 201411301 | A | 3/2014 |

(56) References Cited

FOREIGN PATENT DOCUMENTS

| | | | |
|---|---|---|---|
| WO | 2011024491 | A1 | 3/2011 |
| WO | 2014038725 | A1 | 3/2014 |

OTHER PUBLICATIONS

Aug. 12, 2016—U.S. Notice of Allowance—U.S. Appl. No. 15/014,137.
Aug. 22, 2016—U.S. Non-Final Office Action—U.S. Appl. No. 15/016,646.
Dec. 15, 2016—U.S. Non-Final Office Action—U.S. Appl. No. 15/015,323.
Feb. 3, 2016—U.S. Co-pending U.S. Appl. No. 15/014,137.
Feb. 4, 2016—U.S. Co-pending U.S. Appl. No. 15/015,323.
Feb. 4, 2016—U.S. Co-pending U.S. Appl. No. 15/015,788.
Feb. 5, 2016—U.S. Co-pending U.S. Appl. No. 15/016,581.
Feb. 5, 2016—U.S. Co-pending U.S. Appl. No. 15/016,616.
Feb. 5, 2016—U.S. Co-pending U.S. Appl. No. 15/016,638.
Feb. 5, 2016—U.S. Co-pending U.S. Appl. No. 15/016,646.
Jun. 3, 2016—U.S. Ex-parte Quayle Action—U.S. Appl. No. 15/016,638.
Jun. 6, 2016—U.S. Notice of Allowance—U.S. Appl. No. 15/016,581.
Jun. 17, 2016—U.S. Non-Final Office Action—U.S. Appl. No. 15/016,616.
May 19, 2016—U.S. Non-Final Office Action—U.S. Appl. No. 15/014,137.
Nov. 4, 2016—U.S. Non-Final Office Action—U.S. Appl. No. 15/015,788.
Oct. 11, 2016—U.S. Notice of Allowance—U.S. Appl. No. 15/016,616.
Oct. 13, 2016—U.S. Notice of Allowance—U.S. Appl. No. 15/016,638.
Oct. 21, 2016—U.S. Non-Final Office Action—U.S. Appl. No. 15/016,581.
Apr. 24, 2017—U.S. Notice of Allowance—U.S. Appl. No. 15/015,323.
Apr. 21, 2017—U.S. Notice of Allowance—U.S. Appl. No. 15/016,581.
Jan. 3, 2017—U.S. Notice of Allowance—U.S. Appl. No. 15/016,646.
Mar. 6, 2017—U.S. Notice of Allowance—U.S. Appl. No. 15/016,638.
Mar. 15, 2017—U.S. Notice of Allowance—U.S. Appl. No. 15/015,788.
Jul. 13, 2017—U.S. Notice of Allowance—U.S. Appl. No. 15/583,207.
Aug. 11, 2017—U.S. Non-Final Office Action—U.S. Appl. No. 15/379,654.
Aug. 23, 2017—U.S. Notice of Allowance—U.S. Appl. No. 15/630,391.
Dec. 15, 2017—U.S. Non-final Office Action—U.S. Appl. No. 15/803,006.
Apr. 24, 2018—(JP) Notice of Reasons for Rejection—App 2015-022594, Eng Tran.
Nov. 7, 2018—U.S. Notice of Allowance—U.S. Appl. No. 16/012,970.
Oct. 2, 2019—U.S. Notice of Allowance—U.S. Appl. No. 16/358,834.

* cited by examiner

101

IMAGE FORMING APPARATUS WITH SIDE FRAMES

CROSS-REFERENCE TO RELATED APPLICATION

This application is a continuation of U.S. patent application Ser. No. 15/643,985, filed Jul. 7, 2017, which is a continuation of U.S. patent application Ser. No. 15/015,323 filed on Feb. 4, 2016, now U.S. Pat. No. 9,772,603 B2, issued Sep. 26, 2017, which claims priority from Japanese Patent Application No. 2015-022594, filed on Feb. 6, 2015, which are incorporated herein by reference in their entirety.

TECHNICAL FIELD

Aspects described herein relate to an electrophotographic image forming apparatus.

BACKGROUND

A known electrophotographic image forming apparatus includes a main body and one or more photosensitive drums. Each of the one or more photosensitive drums is disposed within the main body and is configured to carry a developing agent image thereon.

For example, a color laser printer includes a drum unit and four developing cartridges. The drum unit holds four photosensitive drums. The drum unit is attachable to and detachable from a casing of the color laser printer in a sliding manner. The developing cartridges are provided for the respective photosensitive drums and are attachable to and detachable from the drum unit.

In the color laser printer, the drum unit includes side plates that support respective end portions of the photosensitive drums in a width direction of the drum unit. The developing cartridges are attached to the drum unit while being interposed between the side plates in the width direction.

Each male coupling member is coupled to a female coupling member of a corresponding one of the developing cartridges through a coupling passing hole defined in one of the side plates. The coupled male coupling member is free from forward movement and backward movement relative to the corresponding female coupling member but is not rotatable relative to the corresponding female coupling member. With this coupling, a driving force is inputted to the female coupling members from the casing of the color laser printer.

SUMMARY

In the color laser printer, at the time of disengaging the coupling of the male coupling members and the female coupling members from each other, the male coupling members may need to be moved to respective positions closer to an exterior of the color laser printer than the side plate in the width direction of the drum unit so that the male coupling members do not interfere with the side plate when the drum unit is slid for detachment.

In order to achieve this, it may be necessary for the male coupling members to move at least by a distance of the thickness of the side plate. Nevertheless, this requirement may make it difficult to reduce a size of the color laser printer.

Accordingly, some embodiments of the disclosure provide for an image forming apparatus having a reduced size.

DESCRIPTION OF THE DRAWINGS

Aspects of the disclosure are illustrated by way of example and not by limitation in the accompanying figures in which like reference characters indicate similar elements.

DETAILED DESCRIPTION

For a more complete understanding of the present disclosure, needs satisfied thereby, and the objects, features, and advantages thereof, reference now is made to the following descriptions taken in connection with the accompanying drawings. Hereinafter, illustrative embodiments of the disclosure will be described in detail with reference to the accompanying drawings.

1. PRINTER

Figure 1:
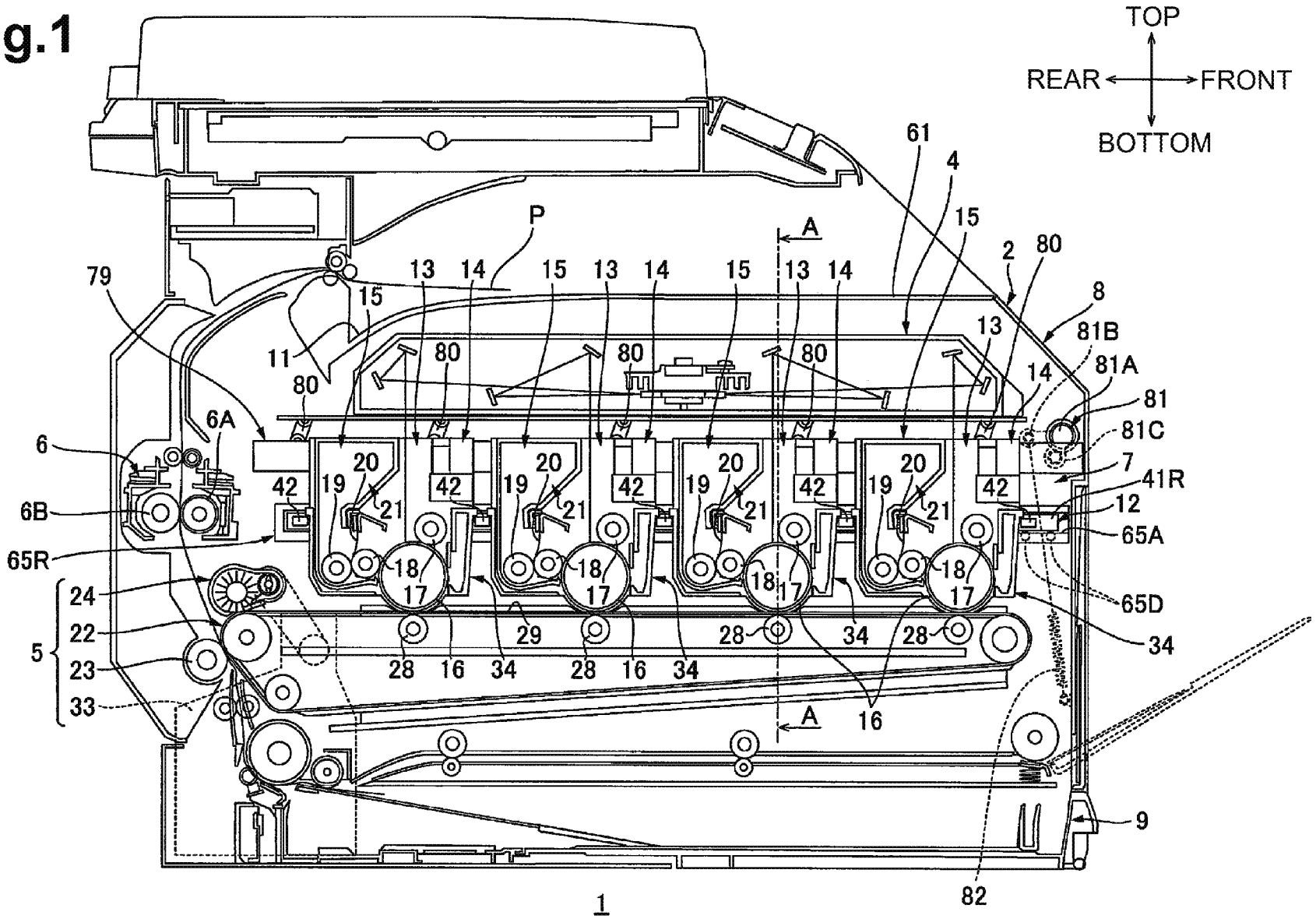
FIG. 1 is a central sectional view depicting a printer as an image forming apparatus in a first illustrative embodiment according to one or more aspects of the disclosure.

As depicted in FIG. 1, a printer 1 may be an intermediate transfer type color printer.

With reference to the printer 1, directions of up, down, right, left, front, and rear may be defined with reference to an orientation of the printer 1 that may be disposed in which it may be intended to be used as depicted in FIG. 1.

The printer 1 includes a main body 2, a support frame 12, a plurality of, for example, four, process cartridges 13, a scanner unit 4, a transfer unit 5, and a fixing unit 6. The main body 2 has an opening 7.

The opening 7 is defined in a front end portion of the main body 2. The opening 7 provides communication between the inside and the outside of the main body 2 in a front-rear direction (as an example of a sliding direction) to allow the support frame 12 and the process cartridges 13 to pass therethrough.

The main body 2 has a generally box shape. The main body 2 includes a front cover 8, a feed tray 9, and a discharge tray 11.

The front cover 8 is disposed at a front end of the main body 2 so as to close the opening 7. The front cover 8 has a general flat plate shape extending in an up-down direction. The front cover 8 is configured to swing between a closing position (e.g., a position of the front cover 8 depicted in FIG. 1) and an exposing position (e.g., a position of the front cover 8 depicted in FIG. 10) on its lower end. When the front cover 8 is located at the closing position (refer to FIG. 1), the front cover 8 closes the opening 7. When the front cover 8 is located at the exposing position (refer to FIG. 10), the front cover 8 is inclined frontward relative to the closing position and exposes the opening 7.

The feed tray 9 is disposed at a bottom portion of the main body 2. The feed tray 9 is configured to support one or more sheets P therein. One or more sheets P supported by the feed tray 9 are fed, one by one, to between an intermediate transfer belt 29 and a secondary transfer roller 23 at a predetermined timing by rotation of rollers.

The discharge tray 11 is disposed at the top of the main body 2. The discharge tray 11 is a recessed portion that is provided at the top of the main body 2 and recessed downward relative to an upper surface of the main body 2.

The support frame 12 is disposed at a substantially middle portion of the main body 2 in the up-down direction. The support frame 12 has a generally frame-like shape extending in the front-rear direction. The support frame 12 supports a substantially middle portion of each of the process cartridges 13 in the up-down direction.

The process cartridges 13 are spaced apart from each other in the front-rear direction. All of the process cartridges 13 have the same or similar configuration except color of toner stored therein, and therefore, one of the process cartridges 13 will be described in detail. The process cartridge 13 includes a drum unit 14 and a developing unit 15.

The drum unit 14 includes a photosensitive drum 16, a charging roller 17, and a drum cleaner 34.

The photosensitive drum 16 is disposed at a lower end portion of the drum unit 14. The photosensitive drum 16 is configured to rotate counterclockwise in left side view.

The charging roller 17 is disposed above and to the front of the photosensitive drum 16. The charging roller 17 is in contact with an upper front end portion of the photosensitive drum 16. The charging roller 17 is configured to charge a surface of the photosensitive drum 16.

The drum cleaner 34 is disposed in front of the photosensitive drum 16. The drum cleaner 34 is configured to clean the surface of the photosensitive drum 16.

The developing unit 15 is disposed above and to the rear of the photosensitive drum 16. The developing unit 15 includes a developing roller 18, a supply roller 19, a layer-thickness regulating blade 20, and a toner storage portion 21.

The developing roller 18 is disposed at a lower front end portion of the developing unit 15. The developing roller 18 is in contact with a rear end portion of the photosensitive drum 16. The developing roller 18 is configured to supply toner onto an electrostatic latent image held by the surface of the photosensitive drum 16 to develop the electrostatic latent image into a toner image.

The supply roller 19 is disposed behind the developing roller 18. The supply roller 19 is in contact with a rear end portion of the developing roller 18. The supply roller 19 is configured to supply toner stored in the toner storage portion 21 onto the developing roller 18.

The layer-thickness regulating blade 20 is disposed above and to the rear the developing roller 18. The layer-thickness regulating blade 20 is in contact with an upper rear end portion of the developing roller 18. The layer-thickness regulating blade 20 is configured to regulate a thickness of a toner layer held by the developing roller 18.

The toner storage portion 21 is disposed above the supply roller 19 and the layer-thickness regulating blade 20. The toner storage portion 21 is configured to store toner therein.

The scanner unit 4 is disposed in an upper end portion of the main body 2 and above the process cartridges 13. The scanner unit 4 is configured to expose the surface of each of the photosensitive drums 16 charged by the respective charging rollers 17 to form an electrostatic latent image on the surface of each of the photosensitive drums 16 based on image data.

The transfer unit 5 includes a belt unit 22, the secondary transfer roller 23, a belt cleaner 24, and a waste toner storage 33.

The belt unit 22 is disposed below the process cartridges 13. The belt unit 22 includes the intermediate transfer belt 29, and a plurality of, for example, four, primary transfer rollers 28.

The intermediate transfer belt 29 may be an endless belt. The intermediate transfer belt 29 rotates clockwise in left side view while being in contact with all of the photosensitive drums 16.

The primary transfer rollers 28 are disposed below the respective photosensitive drums 16 while sandwiching the intermediate transfer belt 29 therebetween. The primary transfer rollers 28 are configured to transfer toner images onto an outer surface of the intermediate transfer belt 29 from the surfaces of the respective photosensitive drums 16.

The secondary transfer roller 23 is disposed behind the belt unit 22 and is in contact with the intermediate transfer belt 29. The secondary transfer roller 23 is configured to transfer the toner images onto a sheet P from the outer surface of the intermediate transfer belt 29.

The belt cleaner 24 is disposed above a rear end portion of the belt unit 22. The belt cleaner 24 is configured to clean the outer surface of the intermediate transfer belt 29.

The waste toner storage 33 is disposed in a lower end portion of the main body 2. The waste toner storage 33 has a generally box shape. The waste toner storage 33 is connected with the belt cleaner 24 by a predetermined piping arrangement. The waste toner storage 33 is configured to store therein transfer residual toner and paper dust collected by the belt cleaner 24.

The fixing unit 6 is disposed above the secondary transfer roller 23. The fixing unit 6 includes a heat roller 6A and a pressing roller 6B. The pressing roller 6B is in pressure contact with a rear end portion of the heat roller 6A. The heat roller 6A and the pressing roller 6B are configured to fix the toner images onto a sheet P by heat.

2. DETAILS OF PROCESS UNIT

(1) Support Frame

Figure 3:
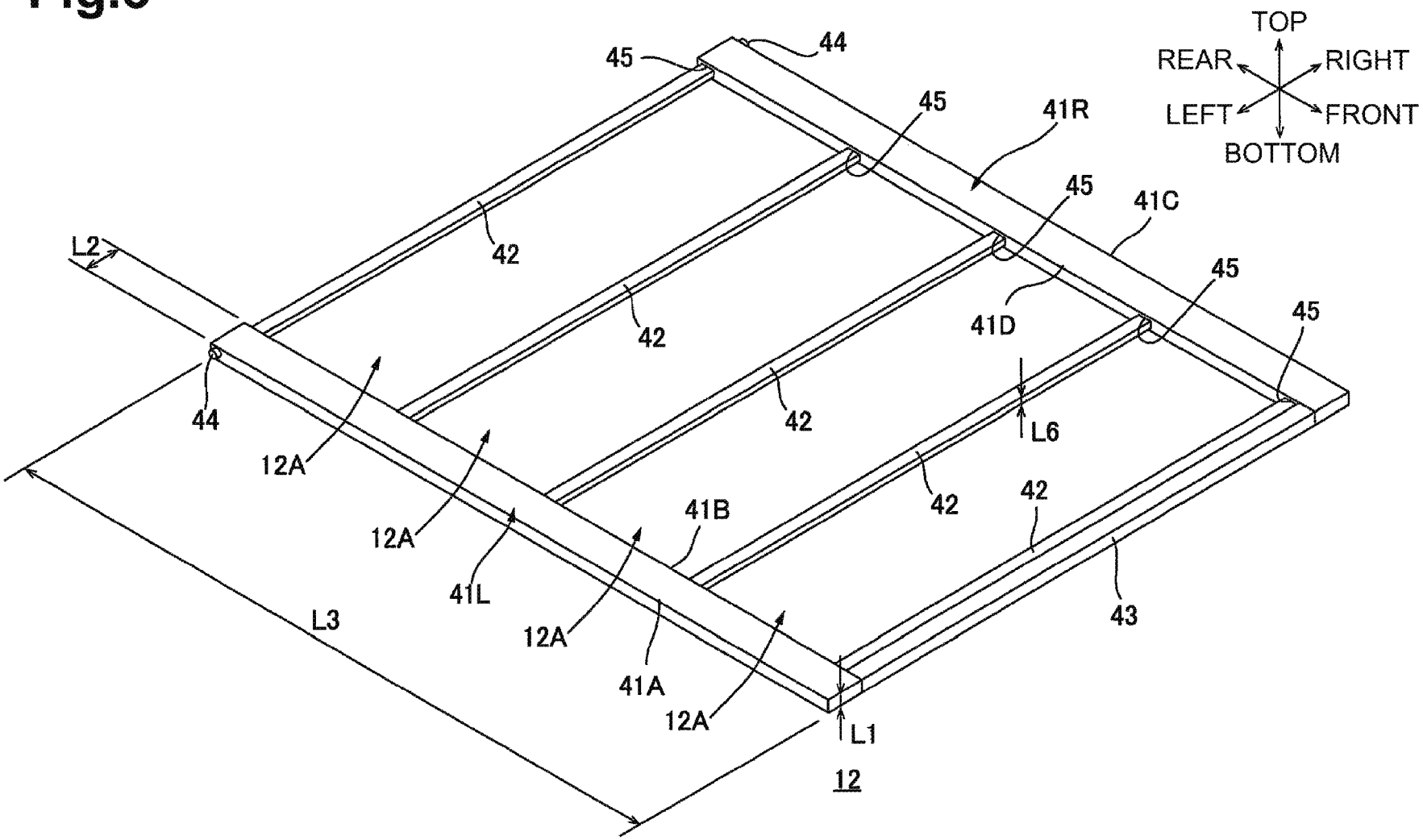
FIG. 3 is an upper front perspective view depicting a support frame of FIG. 1 in the first illustrative embodiment according to one or more aspects of the disclosure.
Figure 7:
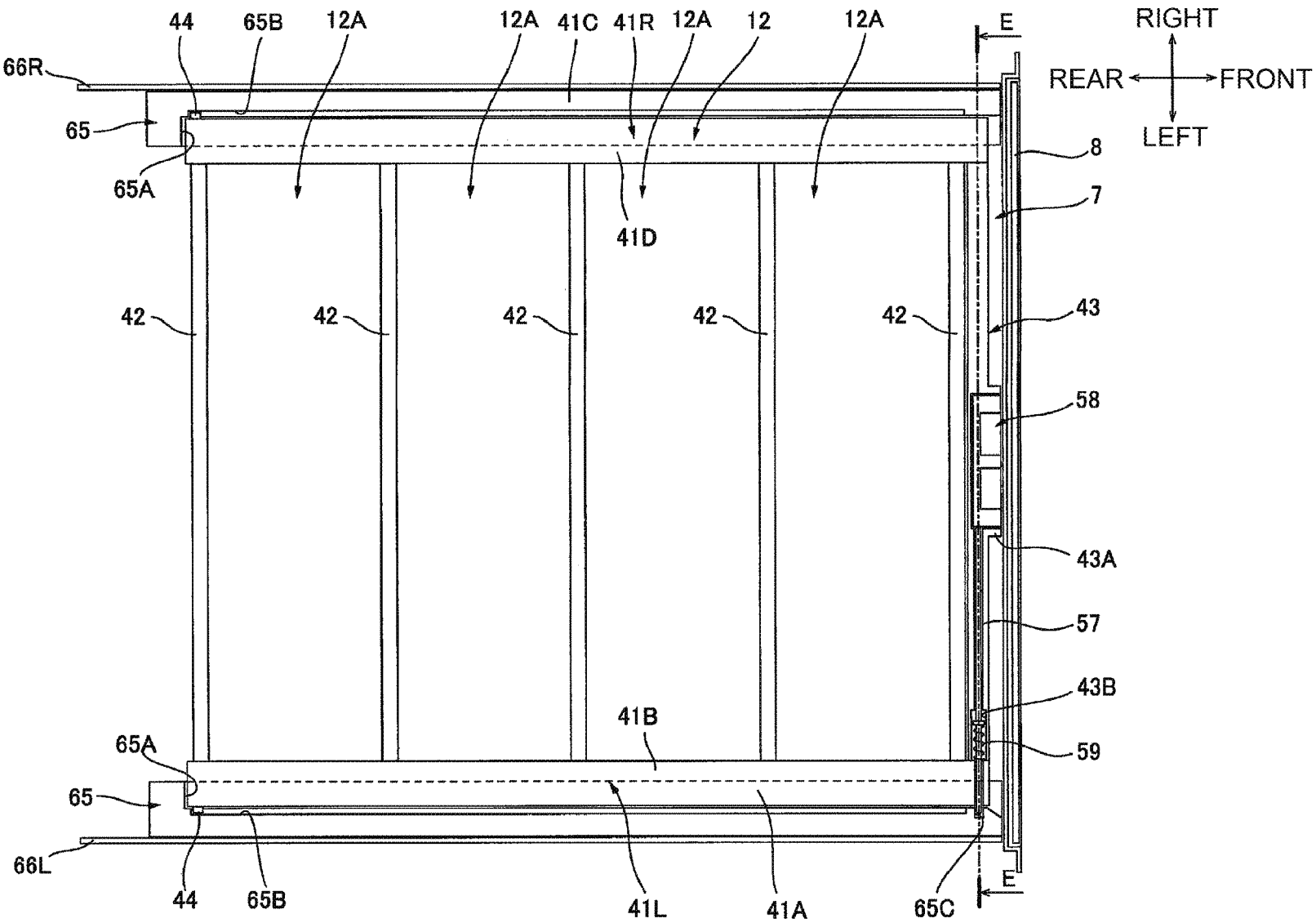
FIG. 7 is a sectional view taken along line D-D of the printer of FIG. 5 in the first illustrative embodiment according to one or more aspects of the disclosure, wherein the process cartridges are omitted for illustrating the support frame clearly.

As depicted in FIGS. 3 and 7, the support frame 12 has a generally rectangular frame shape in plan view. The support frame 12 is configured to move between an inside position (e.g., a position of the support frame 12 depicted in FIG. 1) and an outside position (e.g., a position of the support frame 12 depicted in FIG. 12) in the front-rear direction (e.g., in the sliding direction) through the opening 7. When the support frame 12 is located at the inside position (refer to FIG. 1), the support frame 12 is positioned inside the main body 2. When the support frame 12 is located at the outside position (refer to FIG. 12), the support frame 12 is positioned outside the main body 2. The support frame 12 includes a first side frame 41L, a second side frame 41R, a plurality of, for example, five, beam members 42, a front beam 43, a lock member 57, and a switching member 58.

(a) Side Frames

The first side frame 41L defines a left end of the support frame 12. The first side frame 41L has a bar shape extending in the front-rear direction, and more specifically, has a rectangular column shape. The first side frame 41L may be made of a hard resin material. A dimension in the up-down direction L1 and a dimension in the right-left direction L2 of the first side frame 41L are smaller than a dimension in the front-rear direction L3 of the first side frame 41L. The dimension in the up-down direction L1 of the first side frame 41L is smaller than the dimension in the right-left direction L2 of the first side frame 41L. The first side frame 41L includes a first guided portion 41A, a first cartridge-support portion 41B, and a roller 44. The first guided portion 41A is guided by a first guide portion 65L when the support frame 12 moves in the sliding direction. The first cartridge-support portion 41B is configured to support the process cartridges 13. The first side frame 41L further has a plurality of, for example, five, engagement holes 45.

The first guided portion 41A constitutes a left half portion of the first side frame 41L and is engaged in a first guide groove 65A of the first guide portion 65L.

The first cartridge-support portion 41B constitutes a right half portion of the first side frame 41L and is disposed further to the right than the first guide groove 65A of the first guide portion 65L.

The roller 44 of the first side frame 41L is rotatably supported by a rear end portion of a left surface of the first side frame 41L. The roller 44 has a generally circular plate shape having a thickness in the right-left direction. The roller 44 is engaged in a second guide groove 65B of the first guide portion 65L.

The engagement holes 45 of the first side frame 41L are defined over an area from a front end portion to a rear end portion of the first side frame 41L while being spaced apart from each other in the front-rear direction. The engagement holes 45 are recessed leftward relative to a right surface of the first side frame 41L. The engagement holes 45 have a generally rectangular shape in side view.

The second side frame 41R defines a right end of the support frame 12. The second side frame 41R is disposed at the same level as the first side frame 41L in the up-down direction. The second side frame 41R has a configuration similar to the first side frame 41L. More specifically, the second side frame 41R has a bar shape extending in the front-rear direction, and more specifically, has a rectangular column shape. The second side frame 41R may be made of a hard resin material. A dimension in the up-down direction L1 and a dimension in the right-left direction L2 of the second side frame 41R are smaller than a dimension in the front-rear direction L3 of the second side frame 41R. The dimension in the up-down direction L1 of the second side frame 41R is smaller than the dimension in the right-left direction L2 of the second side frame 41R. The second side frame 41R includes a second guided portion 41C, a second cartridge-support portion 41D, and a roller 44. The second guided portion 41C is guided by a second guide portion 65R when the support frame 12 moves in the sliding direction. The second cartridge-support portion 41D is configured to support the process cartridges 13. The second side frame 41R further has a plurality of, for example, five, engagement holes 45.

The second guided portion 41C constitutes a right half portion of the second side frame 41R and is engaged in a first guide groove 65A of the second guide portion 65R.

The second cartridge-support portion 41D constitutes a left half portion of the second side frame 41R and is disposed further to the left than the first guide groove 65A of the second guide portion 65R.

The roller 44 of the second side frame 41R is rotatably supported by a rear end portion of a right surface of the second side frame 41R. The roller 44 has a generally circular plate shape having a thickness in the right-left direction. The roller 44 is engaged in a second guide groove 65B of the second guide portion 65R.

The engagement holes 45 of the second side frame 41R are defined over an area from a front end portion to a rear end portion of the second side frame 41R spaced apart from each other in the front-rear direction. The engagement holes 45 are recessed rightward relative to a left surface of the second side frame 41R. The engagement holes 45 have a generally rectangular shape in side view.

(b) Beam Members

The beam members 42 are disposed between the first side frame 41L and the second side frame 41R in the right-left direction while being spaced apart from each other in the front-rear direction at regular intervals. The beam members 42 have a generally bar shape extending in the right-left direction, and more specifically, have a generally rectangular column shape. The beam members 42 may be made of metallic material having a higher stiffness, for example, stainless. A dimension in the up-down direction L6 of the beam member 42 is smaller than the dimension in the up-down direction L1 of the first side frame 41L and the dimension in the up-down direction L1 of the second side frame 41R. A right end portion of each of the beam members 42 is fitted in a corresponding one of the engagement holes 45 of the second side frame 41R. A left end portion of each of the beam members 42 is fitted in a corresponding one of the engagement holes 45 of the first side frame 41L. Thus, a space between the first side frame 41L and the second side frame 41R is divided into four areas in the front-rear direction by the beam members 42. In other words, four openings 12A are defined between the first side frame 41L and the second side frame 41R.

(c) Front Beam

Figure 8A:
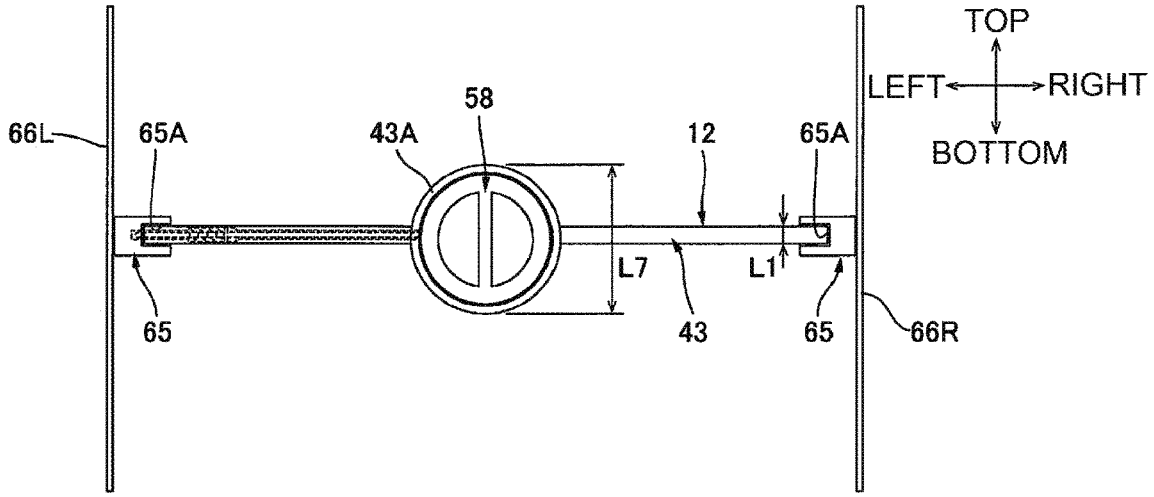
FIG. 8A is a front view depicting the support frame of FIG. 7 in the first illustrative embodiment according to one or more aspects of the disclosure.

The front beam 43 is disposed in front of the frontmost beam member 42 and between a front end portion of the first side frame 41L and a front end portion of the second side frame 41R in the right-left direction. The front beam 43 has a generally rectangular column shape extending in the right-left direction. The front beam 43 may be made of a hard resin material. A left end portion of the front beam 43 is contiguous with the front end portion of the first side frame 41L. A right end portion of the front beam 43 is contiguous with the second side frame 41R. As depicted in FIGS. 7 and 8A, the front beam 43 includes an accommodating portion 43A for accommodating the switching member 58 therein and an accommodating portion 43B for accommodating the lock member 57 therein.

The accommodating portion 43A is disposed at a substantially middle portion of the front beam 43 in the right-left direction. The accommodating portion 43A has a generally cylindrical shape. The accommodating portion 43A extends in the front-rear direction and has a closed rear end. A dimension in a diameter direction L7 of the accommodating portion 43A is greater than the dimension in the up-down direction L1 of the first side frame 41L and the dimension in the up-down direction L1 of the second side frame 41R.

The accommodating portion 43B is disposed at a left portion of the front beam 43. The accommodating portion 43B may be a through hole extending in the right-left direction. A right end of the accommodating portion 43B is contiguous with the accommodating portion 43A such that the inside of the accommodating portion 43B is in communication with the inside of the accommodating portion 43A. The accommodating portion 43B passes through the first side frame 41L and a left end of the accommodating portion 43B is exposed through the left surface of the support frame 12.

(d) Lock Member

The lock member 57 is disposed inside the accommodating portion 43B. The lock member 57 has a generally cylindrical shape extending in the right-left direction. The lock member 57 is movable in the right-left direction between a protruding position (e.g., a position of the lock member 57 depicted in FIG. 8B) and a retracted position (e.g., a position of the lock member 57 depicted in FIG. 8C). When the lock member 57 is located at the protruding position (refer to FIG. 8B), a left end portion of the lock member 57 protrudes relative to the left surface of the first side frame 41L. When the lock member 57 is located at the retracted position (refer to FIG. 8C), an entire portion of the lock member 57 is retracted within the accommodating portion 43B, that is the left end portion of the lock member 57 does not protrudes relative to the left surface of the first side frame 41L. The lock member 57 is urged rightward toward the retracted position at all times by a compression spring 59. When the lock member 57 is located at the retracted position, a right end portion of the lock member 57 is located inside the accommodating portion 43A. When the lock member 57 is located at the protruding position, the right end portion of the lock member 57 is located at a position further to the left than the right end portion of the lock member 57 that is located at the retracted position and thus is not positioned inside the accommodating portion 43A.

(e) Switching Member

The switching member 58 is disposed inside the accommodating portion 43A. The switching member 58 has a generally circular plate shape having a thickness in the front-rear direction. The switching member 58 is rotatable between a locking position (e.g., a position of the switching member 58 depicted in FIG. 8B) and an unlocking position (e.g., a position of the switching member 58 depicted in FIG. 8C). When the switching member 58 is located at the locking position (refer to FIG. 8B), the switching member 58 retains the lock member 57 at the protruding position. When the switching member 58 is located at the unlocking position (refer to FIG. 8C), the switching member 58 retains the lock member 57 at the retracted position. The switching member 58 has a groove 58A.

Figure 8B:
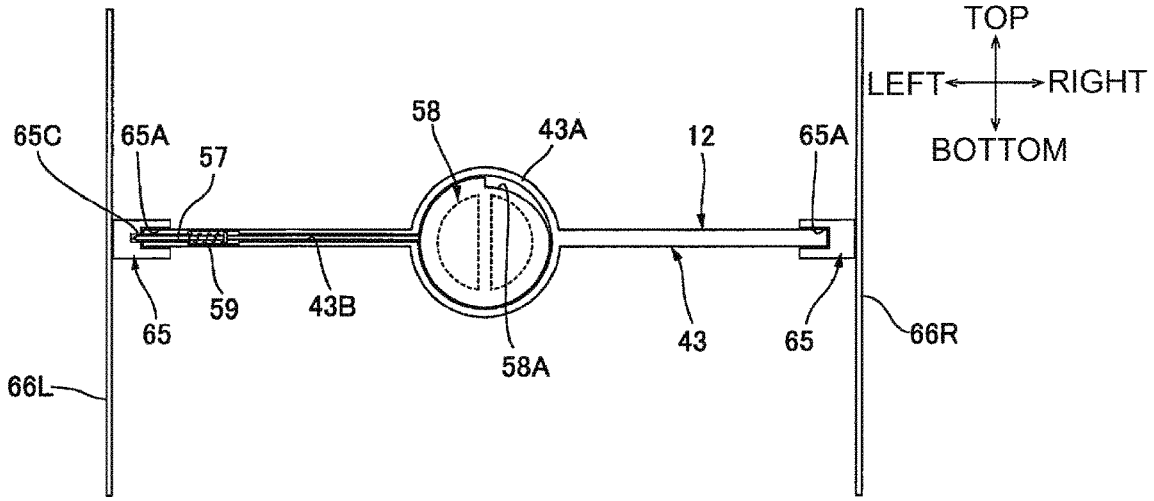
FIG. 8B is a sectional view taken along line E-E of the support frame of FIG. 7 in the first illustrative embodiment according to one or more aspects of the disclosure, wherein a switching member is located at a locking position and a lock member is located at a protruding position.
Figure 8C:
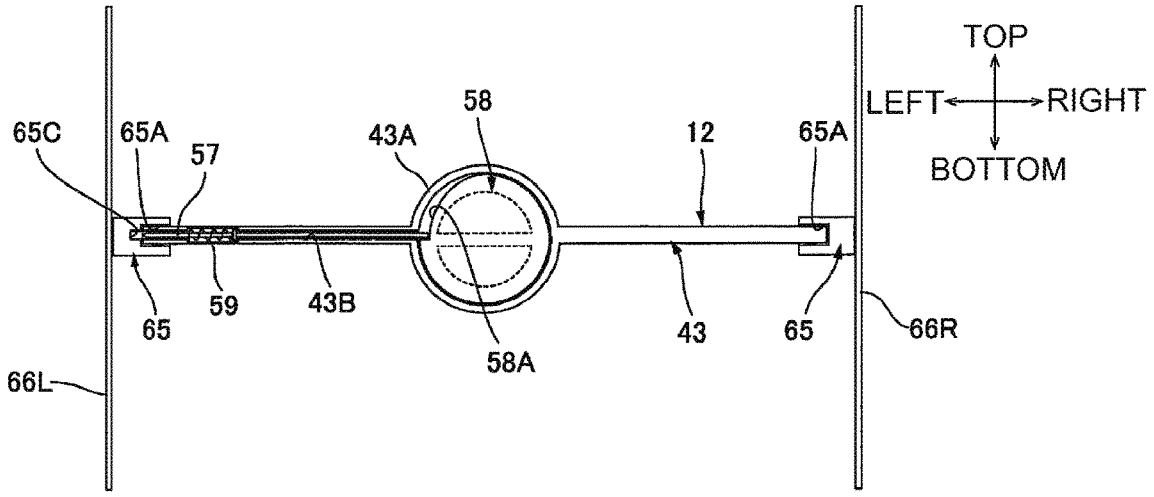
FIG. 8C is a sectional view taken along line E-E of the support frame of FIG. 7 in the first illustrative embodiment according to one or more aspects of the disclosure, wherein the switching member is located at an unlocking position and the lock member is located at a retracted position.

The groove 58A is located at an upper left position in the switching member 58 when the switching member 58 is located at the unlocking position (refer to FIG. 8C). The groove 58A is recessed relative to a peripheral surface of the switching member 58 in a diameter direction of the switching member 58 and extends approximately 90 degrees around the switching member 58 along a circumferential direction of the switching member 58. A depth of the groove 58A becomes shallower in a clockwise direction in front view. The depth at a most upstream end of the groove 58A is substantially equal to a protruding amount of the right end portion of the lock member 57 that protrudes inside the accommodating portion 43A in the right-left direction when the lock member 57 is located at the retracted position.

(2) Process Cartridges

Figure 2:
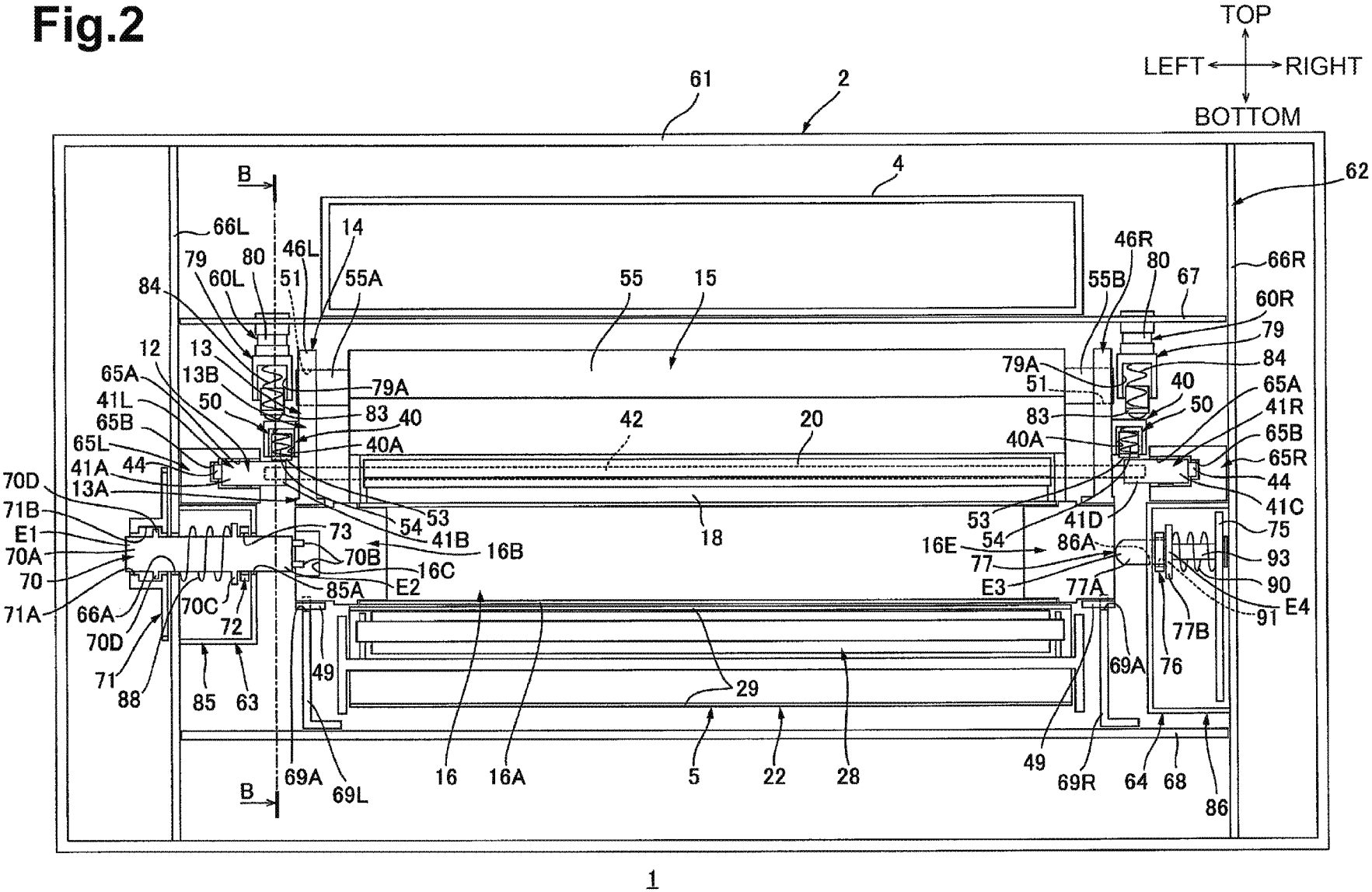
FIG. 2 is a sectional view taken along line A-A of the printer of FIG. 1 in the first illustrative embodiment according to one or more aspects of the disclosure.
Figure 5:
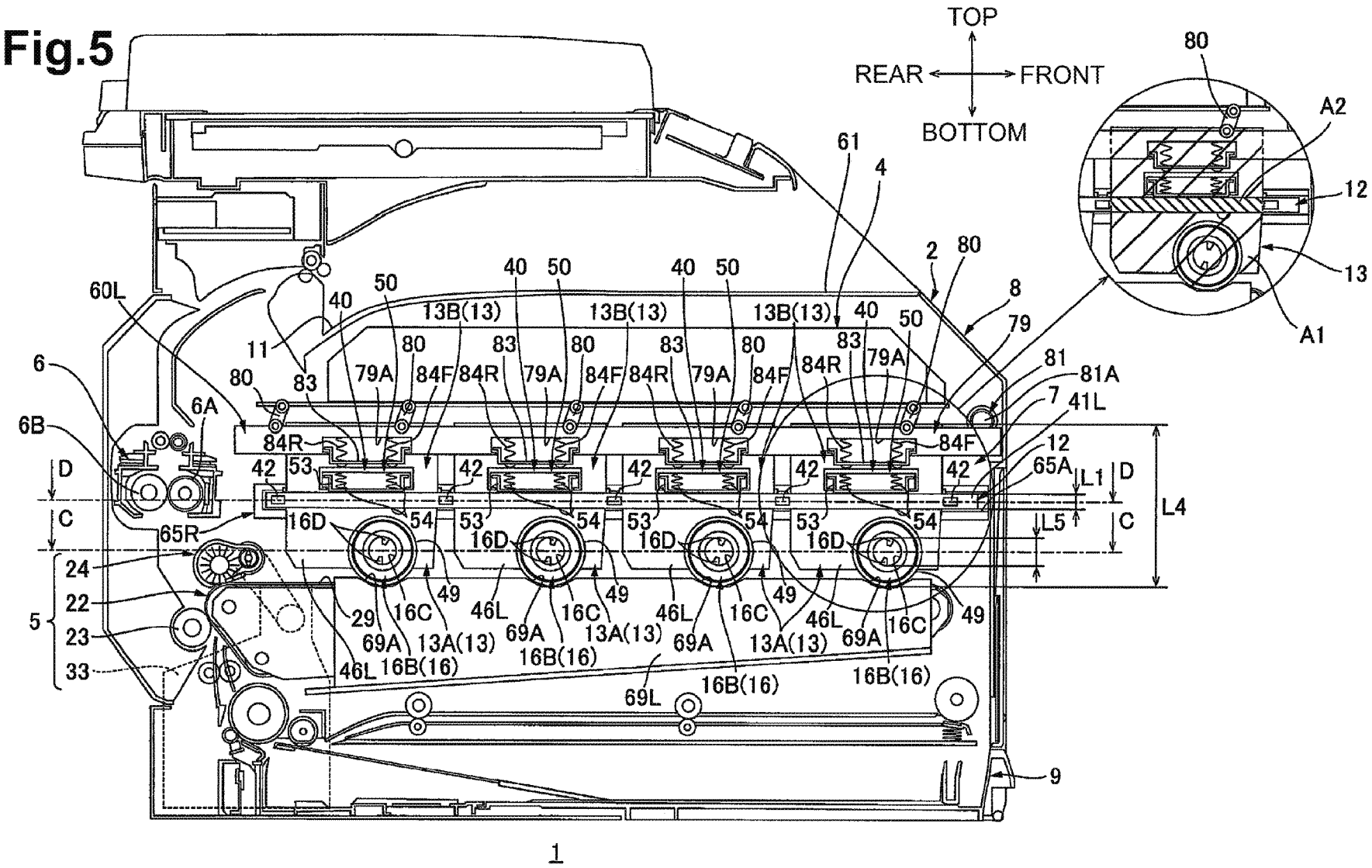
FIG. 5 is a sectional view taken along line B-B of the printer of FIG. 2 in the first illustrative embodiment according to one or more aspects of the disclosure.

As described above, all of the process cartridges 13 have the same or similar configuration except color of toner stored therein and therefore, one of the process cartridges 13 will be described in detail. As depicted in FIGS. 2 and 5, the process cartridge 13 has a generally rectangular column shape extending in the right-left direction. Through insertion of the process cartridge 13 in the up-down direction in an appropriate one of the openings 12A of the support frame 12, the process cartridge 13 is placed in the appropriate opening 12A of the support frame 12 such that the photosensitive drum 16 of the process cartridge 13 is positioned below the support frame 12.

That is, the process cartridge 13 is disposed between corresponding adjacent two of the beam members 42 in the front-rear direction while being disposed between the first side frame 41L and the second side frame 41R in the right-left direction. When viewed in the right-left direction, the process cartridge 13 includes a lower portion 13A and an upper portion 13B with respect to the support frame 12. The lower portion 13A is located below the support frame 12 and the upper portion 13B is located above the support frame 12. The lower portion 13A and the upper portion 13B are exposed from the support frame 12. Of a projected plane A1 of the process cartridge 13, an area of each portion A2 that overlaps one of the first side frame 41L and the second side frame 41R may be 30% or less of a total area of the projected plane A1. The projected plane of the process cartridge refers to an area based on a projection of the process cartridge onto a virtual plane that is perpendicular to the axial direction. Similar projected planes are applicable to the side frames and other structures.

A dimension in the up-down direction L4 of the process cartridge 13 is greater than the dimension in the up-down direction L1 of the first side frame 41L and the dimension in the up-down direction L1 of the second side frame 41R. In other words, the dimension in the up-down direction L1 of the first side frame 41L and the dimension in the up-down direction L1 of the second side frame 41R are smaller than the dimension in the up-down direction L4 of the process cartridge 13. More specifically, the dimension in the up-down direction L1 of the first side frame 41L and the dimension in the up-down direction L1 of the second side frame 41R may be between 5% and 30% inclusive, and preferably, between 10% and 20% inclusive, of the dimension in the up-down direction L4 of the process cartridge 13.

Figure 11:
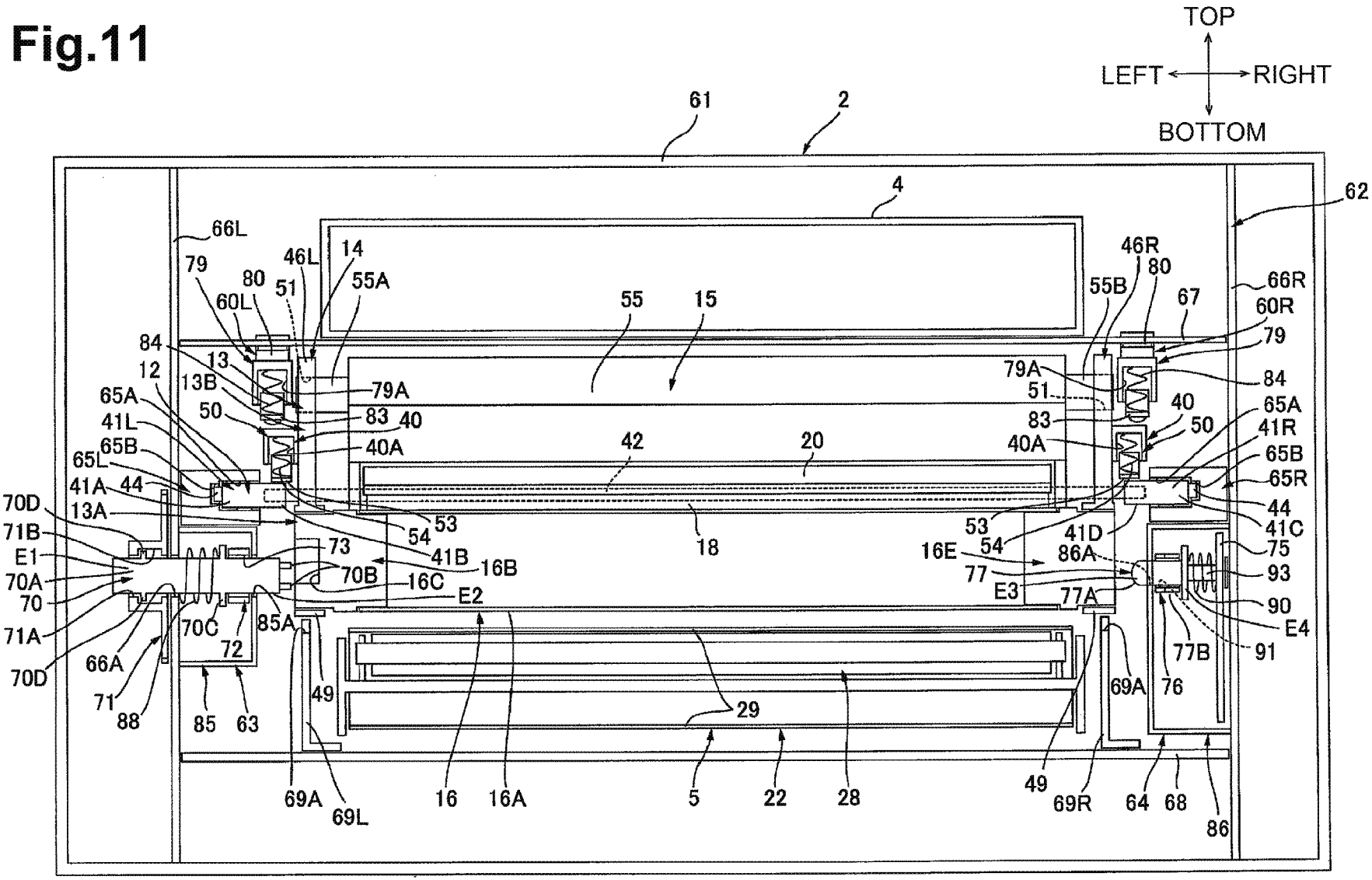
FIG. 11 is a sectional view taken along line A-A of the printer of FIG. 1 in the first illustrative embodiment according to one or more aspects of the disclosure, wherein the front cover is located at the exposing position and the process cartridge is located at the second position.

The process cartridge 13 is movable between a first position (e.g., a position of the process cartridge 13 depicted in FIG. 2) and a second position (e.g., a position of the process cartridge depicted in FIG. 11). When the process cartridge 13 is located at the first position (refer to FIG. 2), the photosensitive drum 16 is in contact with the intermediate transfer belt 29. When the process cartridge 13 is located at the second position (refer to FIG. 11), the photosensitive drum 16 is positioned at a distance from the intermediate transfer belt 29.

As described above, the process cartridge 13 includes the drum unit 14 and the developing unit 15.

(a) Drum Unit

Figure 6:
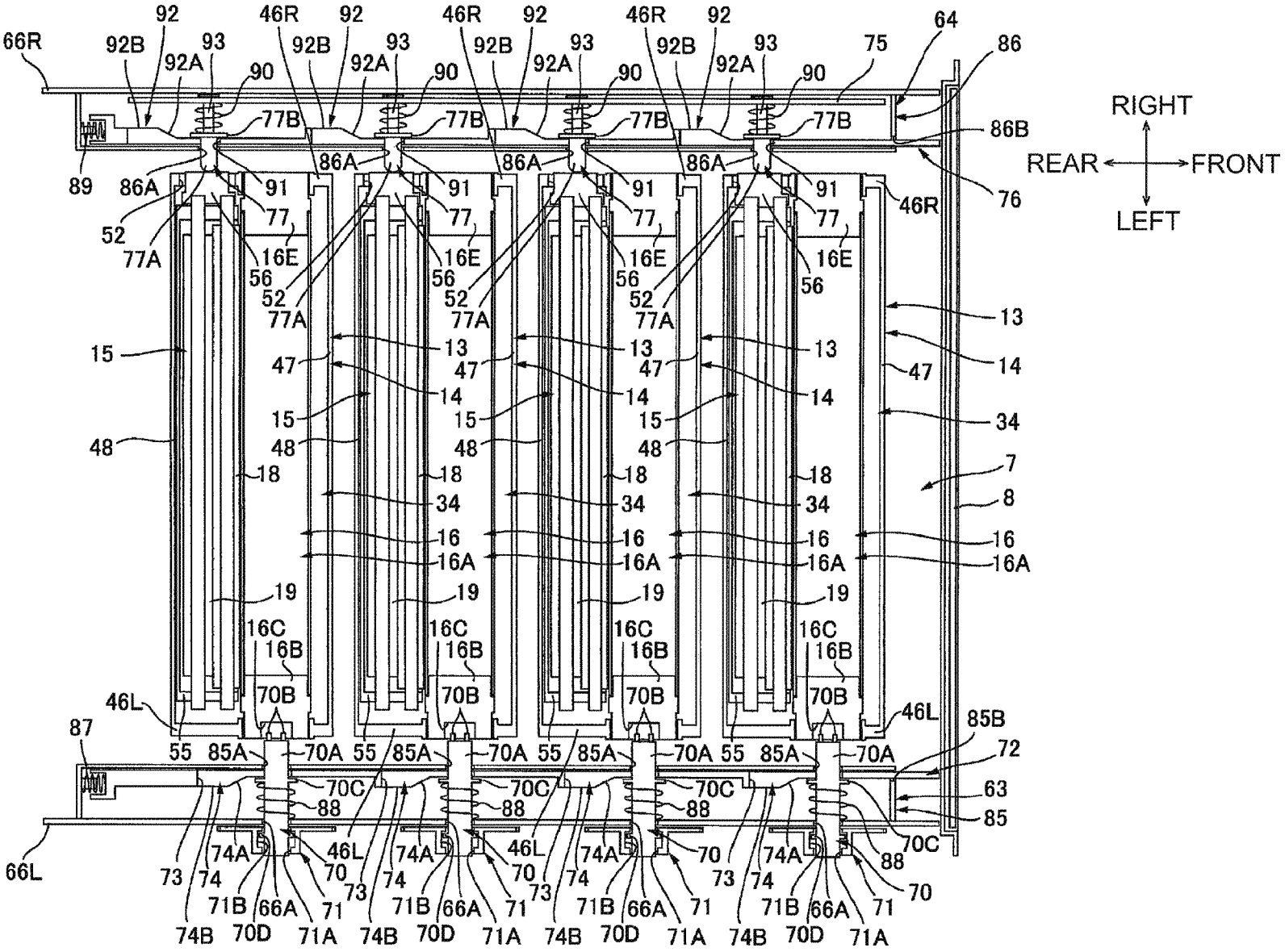
FIG. 6 is a sectional view taken along line C-C of the printer of FIG. 5 in the first illustrative embodiment according to one or more aspects of the disclosure.

As depicted in FIGS. 2 and 6, the drum unit 14 has a generally box shape with its upper end opened. The drum unit 14 includes a first side wall 46L, a second side wall 46R, a front wall 47, and a rear wall 48.

(a-1) Side Walls

Figure 4A:
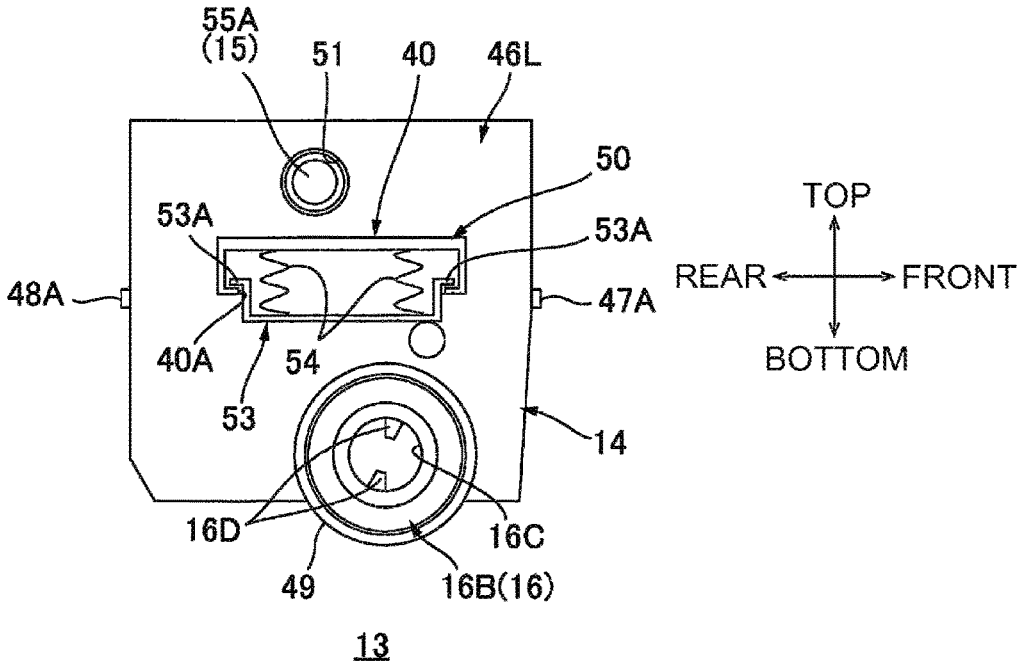
FIG. 4A is a left side view depicting a process cartridge depicted in FIG. 1 in the first illustrative embodiment according to one or more aspects of the disclosure.

As depicted in FIGS. 2 and 4A, the first side wall 46L defines a left end of the drum unit 14. The first side wall 46L has a generally rectangular flat plate shape in side view. The first side wall 46L includes a drum support portion 49, an urging portion 50, and a developing-unit support portion 51.

The drum support portion 49 is disposed to the front with respect to a middle portion of the first side wall 47 in the front-rear direction at a lower end portion of the first side wall 46L. The drum support portion 49 has a generally cylindrical shape extending in the right-left direction. The drum support portion 49 penetrates the first side wall 46L in the right-left direction.

The urging portion 50 is disposed at a substantially middle portion of the first side wall 46L in the up-down direction. The urging portion 50 includes an accommodating member 40, a contact member 53, and a plurality of, for example, two, compression springs 54.

The accommodating member 40 protrudes leftward from a left surface of the first side wall 46L and has a generally box shape extending in the front-rear direction. The accommodating member 40 overlaps the first side frame 41L when projected in the up-down direction. The accommodating member 40 has an opening 40A.

The opening 40A penetrates a portion of a lower wall of the accommodating member 40 in the up-down direction. The opening 40A extends across almost an entire portion of the lower wall of the accommodating member 40 in the front-rear direction other than front and rear end portions of the accommodating member 40 in the front-rear direction.

The contact member 53 is placed in the opening 40A of the accommodating member 40. The contact member 53 extends in the front-rear direction and has a generally box shape with its upper end opened. The contact member 53 is in contact with an upper surface of the first cartridge-support portion 41B of the first side frame 41L. The contact member 53 is movable between a retracted position (e.g., a position of the contact member 53 depicted FIG. 5) and a protruding position (e.g., a position of the contact member 53 depicted FIG. 10). When the contact member 53 is located at the retracted position (refer to FIG. 5), the contact member 53 is positioned within the accommodating member 40 via the opening 40A while contracting the compression springs 54. When the contact member 53 is located at the protruding position (refer to FIG. 10), the contact member 53 protrudes relative to the accommodating member 40 via the opening 40A so as to release the compression of the compression springs 54. The contact member 53 includes a plurality of, for example, two, engagement portions 53A.

The engagement portions 53A are spaced apart from each other in the front-rear direction. One of the engagement portions 53A (e.g., the front engagement portion 53A) has a generally flat plate shape and protrudes frontward from a front end of the contact member 53. The front engagement portion 53A is in engagement with a lower wall of the accommodating member 40 at a circumference edge of the opening 40A. The other of the engagement portions 53A (e.g., the rear engagement portion 53A) also has a generally flat plate shape and protrudes rearward from a rear end of the contact member 53. The rear engagement portion 53A is in engagement with the lower wall of the accommodating member 40 at the circumference edge of the opening 40A.

The compression springs 54 are disposed in a contracted state while being spaced apart from each other in the front-rear direction inside the urging portion 50. The compression springs 54 are coil springs that extends and contracts in the up-down direction. In each of the compression springs 54, an upper end of the compression spring 54 is in contact with an inner surface, e.g., a lower surface, of an upper wall of the accommodating member 40 and a lower end of the compression spring 54 is in contact with an inner surface, e.g., an upper surface, of the lower wall of the accommodating member 40. Thus, the compression springs 54 urges the contact member 53 downward with respect to the accommodating member 40. In other words, the compression springs 54 urge the accommodating member 40 upward with respect to the contact member 53. That is, the compression springs 54 urge the accommodating member 40 upward at front and rear end portions of the accommodating member 40 in the front-rear direction.

The developing-unit support portion 51 is disposed at a substantially middle portion of an upper end portion of the first side wall 46L in the front-rear direction. The developing-unit support portion 51 has a generally circular shape in side view and penetrates the first side wall 46L in the right-left direction.

Figure 4B:
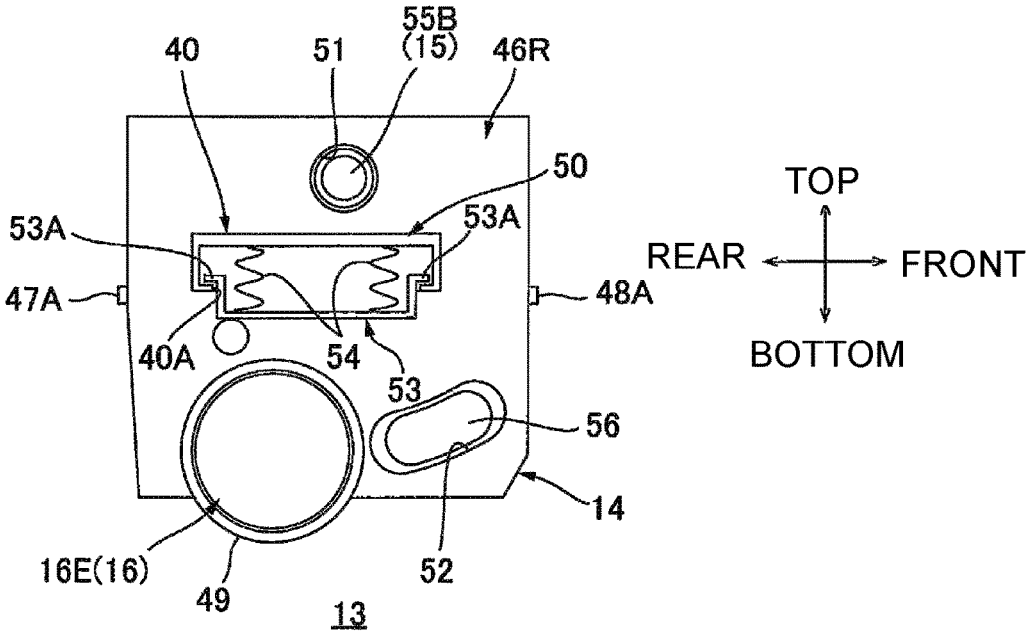
FIG. 4B is a right side view depicting the process cartridge depicted in FIG. 1 in the first illustrative embodiment according to one or more aspects of the disclosure.

As depicted in FIGS. 2 and 4B, the second side wall 46R defines a right end of the drum unit 14. The second side wall 46R has a generally rectangular flat plate shape in side view. The second side wall 46R includes a drum support portion 49, an urging portion 50, a developing-unit support portion 51, and an opening 52. That is, the second side wall 46R has a configuration similar to the first side wall 46L except further has an opening 52. The accommodating member 40 of the second side wall 46R protrudes rightward from a right surface of the second side wall 46R. The accommodating member 40 overlaps the second side frame 41R when projected in the up-down direction. The contact member 53 of the second side wall 46R is in contact with an upper surface of the second cartridge-support portion 41D of the second side frame 41R.

The opening 52 is defined in a lower end portion of the second side wall 46R and is disposed behind the drum support portion 49 in the front-rear direction. The opening 52 penetrates the second side wall 46R in the right-left direction. The opening 52 has an arc shape in side view, in which the developing-unit support portion 51 may be the center of the arc. The opening 52 extends upward toward the rear.

(a-2) Front Wall

As depicted in FIGS. 1 and 6, the front wall 47 is disposed between a front end portion of the first side wall 46L and a front end portion of the second side wall 46R. The front wall 47 has a generally flat plate shape extending in the right-left direction. The front wall 47 also serves as a front wall of the drum cleaner 34. A left end of the front wall 47 is connected with the front end portion of the first side wall 46L. A right end of the front wall 47 is connected with the front end portion of the second side wall 46R. The front wall 47 includes a rib 47A (refer to FIGS. 4A and 4B).

The rib 47A is disposed at a substantially middle portion of the front wall 47 in the up-down direction. The rib 47A protrudes frontward from a front surface of the front wall 47. The rib 47A has a generally flat plate shape extending in the right-left direction. The rib 47A is in contact with an upper surface of a rear end portion of a corresponding beam member 42.

(a-3) Rear Wall

The rear wall 48 is disposed between a rear end portion of the first side wall 46L and a rear end portion of the second side wall 46R. The rear wall 48 has a generally flat plate shape extending in the right-left direction. A left end of the rear wall 48 is connected with the rear end portion of the first side wall 46L. A right end portion of the rear wall 48 is connected with the rear end portion of the second side wall 46R. The rear wall 48 includes a rib 48A (refer to FIGS. 4A and 4B).

The rib 48A is disposed at a substantially middle portion of the rear wall 48 in the up-down direction. The rib 48A protrudes rearward from a rear surface of the rear wall 48. The rib 48A has a generally flat plate shape extending in the right-left direction. The rib 48A is in contact with an upper surface of a front end portion of a corresponding beam member 42.

(a-4) Photosensitive Drum

As depicted in FIGS. 2 and 4A, the photosensitive drum 16 includes a drum body 16A, a first flange member 16B, and a second flange member 16E.

The drum body 16A has a generally cylindrical shape extending in the right-left direction. The drum body 16A has a photosensitive layer on its surface.

The first flange member 16B is rotatably fitted to the drum support portion 49 of the first side wall 46L while being attached to a left end portion of the drum body 16A so as not to be rotatable relative to the drum body 16A. The first flange member 16B has a generally cylindrical column shape extending in the right-left direction. The first flange member 16B has a coupling recess 16C and includes a plurality of, for example, two protrusions 16D. The first flange member 16B is configured to engage with a main-body coupling 70 of the main body 2 and receive a driving force from the main body 2.

The coupling recess 16C is recessed rightward relative to a left surface of the first flange member 16B. The coupling recess 16C has a generally circular shape in side view. A dimension in a diameter direction L5 of the coupling recess 16C of the photosensitive drum 16 (refer to FIG. 5) is greater than the dimension in the up-down direction L1 of the first side frame 41L.

The protrusions 16D are spaced apart from each other in the diameter direction of the coupling recess 16C in the coupling recess 16C while facing each other. The protrusions 16D protrude toward the center of the coupling recess 16C in the diameter direction from an inner circumferential surface of the coupling recess 16C. The protrusions 16D each have a generally rectangular shape in side view.

The second flange member 16E is rotatably fitted to the drum support portion 49 of the second side wall 46R while being attached to a right end portion of the drum body 16A so as not to be rotatable relative to the drum body 16A. The second flange member 16E has a generally cylindrical column shape extending in the right-left direction. That is, the second flange member 16E has a configuration similar to the first flange member 16B. The second flange member 16E does not include a coupling recess 16C and protrusions 16D that the first flange member 16B includes.

(b) Developing Unit

As depicted in FIGS. 2 and 6, the developing unit 15 includes a developing frame 55 and a developing electrode 56. The developing electrode 56 is configured to receive electric power from the main body 2.

The developing frame 55 has a generally box shape extending in the right-left direction. The developing frame 55 includes a toner storage portion 21 inside thereof (refer to FIG. 1). As depicted above, the developing frame 55 includes the developing roller 18, the supply roller 19, and the layer-thickness regulating blade 20. The developing frame 55 further includes a first swing shaft 55A and a second swing shaft 55B.

The first swing shaft 55A is disposed at an upper portion of a left end of the developing frame 55. The first swing shaft 55A has a generally cylindrical shape and extends leftward from a left surface of the developing frame 55. The second swing shaft 55B is disposed at an upper portion of a right end of the developing frame 55. The second swing shaft 55B has a generally cylindrical shape and extends rightward from a right surface of the developing frame 55. The first swing shaft 55A and the second swing shaft 55B have a common axis as their center. The first swing shaft 55A is rotatably fitted to the developing-unit support portion 51 of the first side wall 46L. The second swing shaft 55B is rotatably fitted to the developing-unit support portion 51 of the second side wall 46R. The developing unit 15 is swingable on the first swing shaft 55A and the second swing shaft 55B between a contacting position (e.g., a position of the developing unit 15 depicted in FIG. 1) and a non-contacting position (not depicted). When the developing unit 15 is located at the contacting position (refer to FIG. 1), the developing roller 18 is in contact with the photosensitive drum 16. When the developing unit 15 is located at the non-contacting position (not depicted), the developing roller 18 is positioned at a distance from the photosensitive drum 16.

As depicted in FIGS. 4B and 6, the developing electrode 56 is supported by a right end of the developing frame 55 such that the developing electrode 56 is exposed through the opening 52 of the second side wall 46R when viewed from the right. The developing electrode 56 has a generally oval shape in side view and is elongated in the front-rear direction. The developing electrode 56 is electrically connected to the developing roller 18 and the supply roller 19.

3. DETAILS OF MAIN BODY

As depicted in FIGS. 1 and 2, the main body 2 further includes an outer frame 61, an inner frame 62, a driving unit 63, an electric supply unit 64, a first guide portion 65L, a second guide portion 65R, a first pressing portion 60L, and a second pressing portion 60R.

(1) Outer Frame and Inner Frame

The outer frame 61 constitutes an exterior of the main body 2. The outer frame 61 has a generally box shape. The outer frame 61 may be made of a hard resin. The outer frame 61 includes the discharge tray 11.

The inner frame 62 is disposed inside the outer frame 61. The inner frame 62 has a generally rectangular cylindrical shape. The inner frame 62 extends in the front-rear direction and has an open front end and an open rear end. The inner frame 62 includes a first side plate 66L, a second side plate 66R, an upper plate 67, a lower plate 68, a first positioning plate 69L, and a second positioning plate 69R. The first side plate 66L supports the main-body couplings 70. The second side plate 66R supports main-body electrodes 77.

As depicted in FIGS. 2 and 6, the first side plate 66L is disposed to the right of a left wall of the outer frame 61 and spaced apart from the left wall of the outer frame 61. The first side plate 66L has a generally flat plate shape extending in the up-down direction. The first side plate 66L may be made of a metal having a higher stiffness, for example, stainless or plated iron. The first side plate 66L has a plurality of, for example, four, holes 66A.

The holes 66A are defined in a substantially middle portion of the first side plate 66L in the up-down direction so as to face the respective photosensitive drums 16 from left. That is, the holes 66A are spaced apart from each other in the front-rear direction. The holes 66A penetrate the first side plate 66L in the right-left direction.

The second side plate 66R is disposed to the left of a right wall of the outer frame 61 and spaced apart from the right wall of the outer frame 61. The second side plate 66R has a generally flat plate shape in the up-down direction. The second side plate 66R may be made of a metal having a higher stiffness, for example, stainless or plated iron.

As depicted in FIG. 2, the upper plate 67 is disposed at an upper end portion of the inner frame 62. The upper plate 67 has a generally flat plate shape in the right-left direction. The upper plate 67 may be made of a metal, for example, stainless or plated iron. The upper plate 67 extends between an upper end portion of the first side plate 66L and an upper end portion of the second side plate 66R. The upper plate 67 supports the scanner unit 4.

The lower plate 68 is disposed at a lower end portion of the inner frame 62. The lower plate 68 has a generally flat plate shape extending in the right-left direction. The lower plate 68 may be made of a metal, for example, stainless and plated iron. The lower plate 68 is disposed above the feed tray 9 and extends between a lower end portion of the first side plate 66L and a lower end portion of the second side plate 66R.

As depicted in FIGS. 2 and 5, the first positioning plate 69L and the second positioning plate 69R are disposed between the first side plate 66L and the second side plate 66R at a lower end portion of the inner frame 62 while being spaced apart from each other in the right-left direction. The first positioning plate 69L and the second positioning plate 69R have a generally flat plate shape extending in the up-down direction. The first positioning plate 69L and the second positioning plate 69R may be made of a metal, for example, stainless or plated iron and have an identical shape. A lower end of the first positioning plate 69L and a lower end of the second positioning plate 69R are joined to an upper surface of the lower plate 68. The first positioning plate 69L has a plurality of, for example, four, positioning recesses 69A. The second positioning plate 69R also has a plurality of, for example, four, positioning recesses 69A.

The positioning recesses 69A of the first positioning plate 69L are defined in an upper end portion of the first positioning plate 69L while being spaced apart from each other at regular intervals in the front-rear direction. The positioning recesses 69A of the first positioning plate 69L are recessed downward relative to an upper end of the first positioning plate 69L. The positioning recesses 69A of the second positioning plate 69R are defined in an upper end portion of the second positioning plate 69R while being spaced apart from each other at regular intervals in the front-rear direction. The positioning recesses 69A of the second positioning plate 69R are recessed downward relative to an upper end of the second positioning plate 69R. The positioning recesses 69A of the first positioning plate 69L and the second positioning plate 69R have a generally U shape in side view with its upper end opened. Each of the positioning recesses 69A receives the drum support portion 49 of a corresponding process cartridge 13 to position the photosensitive drum 16 of the corresponding process cartridge 14 in the front-rear direction.

(2) Driving Unit

As depicted in FIGS. 2 and 6, the driving unit 63 is supported by a substantially middle portion of the first side plate 66L in the up-down direction. The driving unit 63 includes a frame 85, a plurality of, for example, four, drum drive gears 71, a translation cam 72, a plurality of, for example, four, main-body couplings 70, and a plurality of, for example, four, compression springs 88.

(a) Frame

The frame 85 is disposed to the right of the first side plate 66L. The frame 85 has a generally box shape extending in the front-rear direction. The frame 85 has a plurality of, for example, four, holes 85A and a hole 85B. The main-body couplings 70 pass through the respective holes 85A. The translation cam 72 passes through the hole 85B.

The holes 85A are defined in an upper end portion of a right wall of the frame 85. The holes 85A are spaced apart from each other in the front-rear direction while facing the respective photosensitive drums 16 from left. The holes 85A penetrate the right wall of the frame 85 in the right-left direction.

The hole 85B is defined in a right end portion of a front wall of the frame 85. The hole 85B penetrates the front wall of the frame 85 in the front-rear direction.

(b) Drum Drive Gear

The drum drive gears 71 are disposed to the left of the first side plate 66L and to the left of the respective holes 85A. The drum drive gears 71 each have a generally disc shape with gear teeth on its circumferential surface entirely. The drum drive gears 71 are rotatably supported by the first side plate 66L. The drum drive gears 71 each have a hole 71A and a plurality of, two, recesses 71B. All of the drum drive gears 71 have the same or similar configuration, and therefore, one of the drum drive gears 71 will be described in detail.

The hole 71A is defined in the center of the drum drive gear 71 in its diameter direction. The hole 71A penetrates the drum drive gear 71 in the right-left direction. The hole 71A has a generally circular shape in side view and its inside diameter may be substantially the same as an inside diameter of the hole 66A of the first side plate 66L. The holes 71A are coincide with the respective holes 66A of the first side plate 66L in the right-left direction.

The hole 71A has the recesses 71B in an inner surface defining the hole 71A in the diameter direction of the hole 71A. The recesses 71B may be grooves, each of which is recessed relative to the inner surface defining the hole 71A in the diameter direction of the hole 71A toward the exterior of the drum drive gear 71 and extends in the right-left direction.

(c) Translation Cam

The translation cam 72 is disposed in a right end portion of the frame 85. The translation cam 72 overlaps the first side frame 41L when projected in the up-down direction. The translation cam 72 has a generally flat plate shape extending in the front-rear direction. A front end portion of the translation cam 72 passes through the hole 85B of the frame 85 and protrudes frontward beyond a front wall of the frame 85. The translation cam 72 is movable in the front-rear direction between a pressing position (e.g., a position of the translation cam 72 depicted in FIG. 9) and a non-pressing position (e.g., a position of the translation cam 72 depicted in FIG. 6). When the translation cam 72 is located at the pressing position (refer to FIG. 9), the translation cam 72 presses the main-body couplings 70 leftward. When the translation cam 72 is located at the non-pressing position (refer to FIG. 6), the translation cam 72 does not press the main-body couplings 70. The translation cam 72 is urged frontward toward the pressing position by the compression spring 87 at all times. When the front cover 8 is located at the closing position, a front end of the translation cam 72 is in contact with a rear surface of the front cover 8 and thus the translation cam 72 is pressed rearward against an urging force of the compression spring 87, whereby the translation cam 72 is retained at the non-pressing position. The translation cam 72 has a plurality of, for example, four, holes 73 and includes a plurality of, for example, four, position switching portions 74.

The holes 73 are spaced apart from each other in the front-rear direction while being defined side by side in the front-rear direction. The holes 73 penetrate the translation cam 72 in the right-left direction. The holes 73 are elongated in the front-rear direction, respectively.

All of the position switching portions 74 have the same or similar configuration, and therefore, one of the position switching portions 74 will be described in detail. The position switching portion 74 protrudes leftward in the right-left direction from a circumferential edge of a rear half portion of a corresponding hole 73 and extends along a circumferential direction of the hole 73. The position switching portion 74 has a generally flat plate shape. The position switching portion 74 has an inclined surface 74A and a parallel surface 74B.

The inclined surface 74A may be a front half portion of a left surface of the position switching portion 74. The inclined surface 74A is inclined leftward toward the rear. A front end of the inclined surface 74A is contiguous with a left surface of the translation cam 72.

The parallel surface 74B is a rear half portion of the left surface of the position switching portion 74. The parallel surface 74B extends rearward contiguous with a rear end of the inclined surface 74A. The parallel surface 74B is parallel to the left surface of the translation cam 72.

(d) Main-Body Couplings

All of the main-body couplings 70 have the same or similar configuration and are disposed at respective positions in the same or similar manner, and therefore, one of the main-body couplings 70 will be described in detail. The main-body coupling 70 is supported so as to be movable in the right-left direction while being disposed in the hole 71A of a corresponding drum drive gear 71. The main-body coupling 70 is disposed to the left of the lower portion 13A of a corresponding process cartridge 13. The main-body coupling 70 has a generally cylindrical column shape extending in the right-left direction. The main-body coupling 70 is movable between an engaged position (e.g., a position of the main-body coupling 70 depicted in FIGS. 2 and 6) and a disengaged position (e.g., a position of the main-body coupling 70 depicted in FIGS. 9 and 11). When the main-body coupling 70 is located at the engaged position (refer to FIGS. 2 and 6), the main-body coupling 70 is in engagement with the coupling recess 16C of the corresponding photosensitive drum 16. When the main-body coupling 70 is located at the disengaged position (refer to FIGS. 9 and 11), the main-body coupling 70 is positioned at a distance from the coupling recess 16C of the corresponding photosensitive drum 16. When the main-body coupling 70 is located at the engaged position, the main-body coupling 70 protrudes into the coupling recess 16C of the corresponding photosensitive drum 16. When the main-body coupling 70 is located at the disengaged position, the main-body coupling 70 is located receding from the coupling recess 16C of the corresponding photosensitive drum 16. The main-body coupling 70 includes a shaft portion 70A, a plurality of, two, protruding portions 70B, and a flange portion 70C.

The shaft portion 70A has a generally cylindrical column shape extending in the right-left direction. The shaft portion 70A passes through the hole 71A of the drum drive gear 71, the hole 66A of the first side plate 66L, the hole 73 of the translation cam 72, and the hole 85A of the frame 85. A second end portion E2 (e.g., a right end portion) of the shaft portion 70A protrudes rightward beyond a right wall of the frame 85 through the hole 85A of the frame 85. The shaft portion 70A includes a plurality of, for example, two, protrusions 70D.

The protrusions 70D have a generally cylindrical column shape. The protrusions 70D protrude from respective portions of a peripheral surface of a first end portion E1 (e.g., a left end portion) of the shaft portion 70A in a diameter direction of the shaft portion 70A. The protrusions 70D are disposed within the respective recesses 71B of the drum drive gear 71 so as to be movable in the right-left direction but not to be movable in the circumferential direction of the drum drive gear 71. With this configuration, the main-body coupling 70 is capable of rotating integral with the drum drive gear 71.

The protruding portions 70B have a generally cylindrical column shape. The protruding portions 70B are disposed at respective portions closer to a circumferential edge of the second end portion E2 in the diameter direction while protruding rightward from the second end portion E2 of the shaft portion 70A.

The flange portion 70C has a generally plate shape. The flange portion 70C protrudes in the diameter direction from a peripheral surface of the shaft portion 70A at a substantially middle portion of the shaft portion 70A in the right-left direction and extends in the circumferential direction of the shaft portion 70A.

The second end portion E2 of the main-body coupling 70 is disposed such that the second end portion E2 is positioned between the first guide portion 65L and the second guide portion 65R and overlaps the first side frame 41L when viewed in the up-down direction in a state where the main-body coupling 70 is located at the disengaged position.

(e) Compression Springs

The compression springs 88 are disposed in a contracted state while being disposed between the flange portions 70C of the respective main-body couplings 70 and the first side plate 66L. Thus, the main-body couplings 70 are urged rightward toward the engaged position at all times.

(3) Electric Supply Unit

The electric supply unit 64 is supported by a substantially middle portion of the second side plate 66R in the up-down direction. The electric supply unit 64 includes a frame 86, a power supply board 75, a plurality of, for example, four, support shafts 93, a translation cam 76, a plurality of, for example, for, main-body electrodes 77, and a plurality of, for example, four, compression springs 90.

The frame 86 is disposed to the left of the second side plate 66R. The frame 86 has a generally box shape extending in the front-rear direction. The frame 86 has a plurality of, for example, four, holes 86A and a hole 86B. The main-body electrodes 77 pass through the respective holes 86A. The translation cam 76 passes through the hole 86B.

The holes 86A are defined in an upper end portion of a left wall of the frame 86. The holes 86A are disposed to the right of the respective developing electrodes 56 while facing the respective developing electrodes 56. The holes 86A are spaced apart from each other in the front-rear direction. The holes 86A penetrate the left wall of the frame 86 in the right-left direction.

The hole 86B is defined in a left end portion of the front wall of the frame 86. The hole 86B penetrates the front wall of the frame 86 in the front-rear direction.

(B) Power Supply Board

The power supply board 75 is disposed between the second side plate 66R and the main-body electrodes 77 in a right end portion of the frame 86. The power supply board 75 has a generally flat plate shape extending both in the up-down direction and in the front-rear direction. The power supply board 75 may be a circuit board including, for example, a transformer and a capacitor. The power supply board 75 is configured to convert electric power supplied from an input power source (not depicted) to a predetermined voltage using the transformer and store the voltage in the capacitor. By doing so, the power supply board 75 controls electric power to be applied on the main-body electrodes 77.

(c) Support Shafts

The support shafts 93 are disposed to the right of the respective holes 86A. The support shafts 93 have a generally cylindrical column shape. The support shafts 93 extend leftward from respective portions of a left surface of the second side plate 66R.

(d) Translation Cam

The translation cam 76 is disposed in a left end portion of the frame 86. The translation cam 76 overlaps the second side frame 41R when projected in the up-down direction. The translation cam 76 has a generally flat plate shape extending in the front-rear direction. A front end portion of the translation cam 76 passes through the hole 86B of the frame 86 and protrudes frontward beyond the front wall of the frame 86. The translation cam 76 is movable in the front-rear direction between a pressing position (e.g., a position of the translation cam 76 depicted in FIG. 9) and a non-pressing position (e.g., a position of the translation cam 76 depicted in FIG. 6). When the translation cam 76 is located at the pressing position (refer to FIG. 9), the translation cam 76 presses the main-body electrodes 77 rightward. When the translation cam 76 is located at the non-pressing position (refer to FIG. 6), the translation cam 76 does not press the main-body electrodes 77. The translation cam 76 is urged frontward toward the pressing position by the compression spring 89 at all times. When the front cover 8 is located at the closing position, a front end of the translation cam 76 is in contact with the rear surface of the front cover 8 and thus the translation cam 72 is pressed rearward against an urging force of the compression spring 89, whereby the translation cam 76 is retained at the non-pressing position. The translation cam 76 has a plurality of, for example, four, holes 91 and a plurality of, for example, four, position switching portions 92.

The holes 91 are spaced apart from each other in the front-rear direction. The holes 91 penetrate the translation cam 76 in the right-left direction. The holes 91 are elongated in the front-rear direction, respectively.

All of the position switching portions 92 have the same or similar configuration, and therefore, one of the position switching portions 92 will be described in detail. The position switching portion 92 protrudes rightward in the right-left direction from a circumferential edge of a rear half portion of a corresponding hole 91 and extends along a circumferential direction of the hole 91. The position switching portions 92 has a generally flat plate shape. The position switching portion 92 has an inclined surface 92A and a parallel surface 92B.

The inclined surface 92A may be a front half portion of a right surface of the position switching portion 92. The inclined surface 92A is inclined rightward toward the rear. A front end portion of the inclined surface 92A is contiguous with a right surface of the translation cam 76.

The parallel surface 92B is a rear half portion of the right surface of the position switching portion 92. The parallel surface 92B extends rearward contiguous with a rear end of the inclined surface 92A. The parallel surface 92B is parallel to the right surface of the translation cam 76.

(e) Main-Body Electrodes

All of the main-body electrodes 77 have the same or similar configuration and are disposed at respective positions in the same or similar manner, and therefore, one of the main-body electrodes 77 will be described in detail. The main-body electrode 77 is disposed to the left of the power supply board 75 while being supported by a corresponding support shaft 93 so as to be movable in the right-left direction. The main-body electrode 77 is disposed to the right of the lower portion 13A of a corresponding process cartridge 13. The main-body electrode 77 is movable between a contacting position (e.g., a position of the main-body electrode 77 depicted in FIGS. 2 and 6) and a non-contacting position (e.g., a position of the main-body electrode 77 depicted in FIGS. 9 and 11). When the main-body electrode 77 is located at the contacting position (refer to FIGS. 2 and 6), the main-body electrode 77 is in contact with the developing electrode 56. When the main-body electrode 77 is located at the non-contacting position (refer to FIGS. 9 and 11), the main-body electrode 77 is not in contact with the developing electrode 56. When the main-body electrode 77 is located at the contacting position, the main-body electrode 77 protrudes toward the developing electrode 56. When the main-body electrode 77 is located at the non-contacting position, the main-body electrode 77 is located receding from the developing electrode 56. The main-body electrode 77 includes a shaft portion 77A and a flange portion 77B.

The shaft portion 77A extends in the right-left direction and has a generally cylindrical column shape with its left end closed. A left wall of the shaft portion 77A has a curved surface of which middle portion in the diameter direction is convex toward the left. The shaft portion 77A passes through the hole 91 of the translation cam 76 and the hole 86A of the frame 86. A second end portion E3 (e.g., a left end portion) of the shaft portion 77A protrudes leftward beyond a left wall of the frame 86 through the hole 86A of the frame 86.

The flange portion 77B has a generally plate shape. The shaft portion 77A protrudes in the diameter direction from a peripheral surface of a first end portion E4 (e.g., a right end portion) and extends in a circumferential direction of the shaft portion 77A.

The main-body electrode 77 is configured to apply a developing bias on a corresponding developing roller 18 via a corresponding developing electrode 56.

The second end portion E3 of the main-body electrode 77 is disposed such that the second end portion E3 is positioned between the first guide portion 65L and the second guide portion 65R and overlaps the second side frame 41R when viewed in the up-down direction in a state where the main-body electrode 77 is located at the non-contacting position.

(f) Compression Springs

The compression springs 90 are disposed in a contracted state while being disposed between the flange portions 77B of the respective main-body electrodes 77 and the power supply board 75. Thus, the main-body electrodes 77 are urged leftward toward the contacting position by the compression springs 90 at all times.

(4) First Guide Portion and Second Guide Portion

As depicted in FIGS. 2 and 7, the first guide portion 65L is disposed to the right of the first side plate 66L and above the driving unit 63. The first guide portion 65L has a generally rectangular column shape extending in the front-rear direction. The first guide portion 65L has a first guide groove 65A and a second guide groove 65B and includes an engagement portion 65C (refer to FIGS. 8B and 8C) and a plurality of, for example, two, rollers 65D (refer to FIG. 1).

The first guide groove 65A of the first guide portion 65L is recessed leftward relative to a right surface of the first guide portion 65L and extends in the front-rear direction. The first guide groove 65A has a generally rectangular shape in sectional view. The first guide groove 65A has an open front end that opens toward the front.

The second guide groove 65B of the first guide portion 65L is recessed leftward relative to a left inner surface defining the first guide groove 65A and extends in the front-rear direction. The second guide groove 65B has a generally rectangular shape in sectional view. The second guide groove 65B has a closed front end.

The engagement portion 65C is disposed in the front of the second guide groove 65B at a front end portion of the first guide portion 65L. The engagement portion 65C is recessed leftward relative to the left inner surface of the first guide groove 65A.

Figure 10:
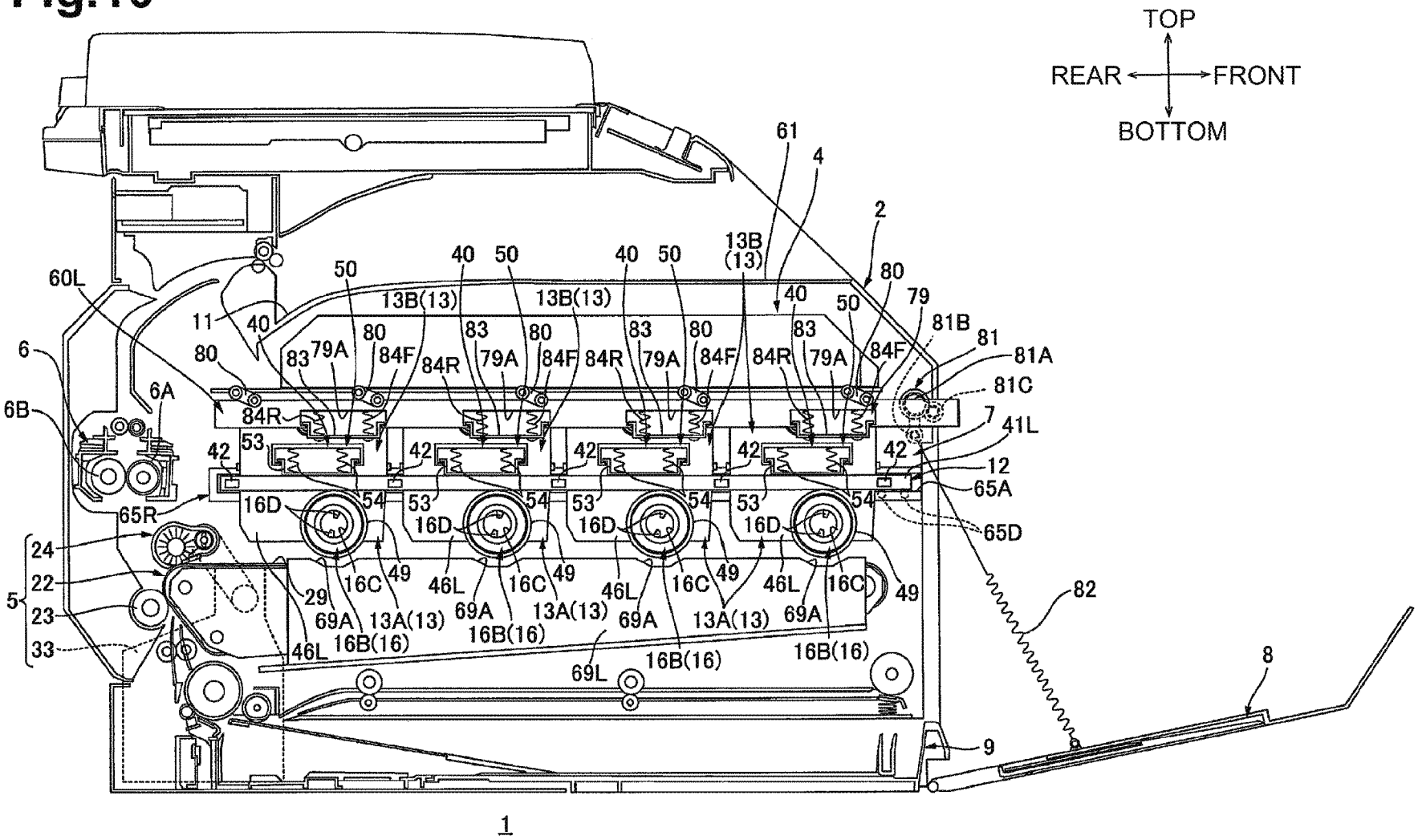
FIG. 10 is a sectional view taken along line B-B of the printer of FIG. 2 in the first illustrative embodiment according to one or more aspects of the disclosure, wherein the front cover is located at the exposing position and the process cartridges are located at a second position.

As depicted in FIGS. 7 and 10, the rollers 65D of the first guide portion 65L are disposed in a front end portion of the first guide groove 65A of the first guide portion 65L while being spaced apart from each other in the front-rear direction. The rollers 65D have a general disc shape and are rotatable on respective axes extending in the right-left direction. Upper end portions of the rollers 65D protrude upward beyond a lower inner surface of the first guide groove 65A.

As depicted in FIGS. 2 and 7, the second guide portion 65R is disposed to the left of the second side plate 66R and above the electric supply unit 64. That is, the first guide portion 65L and the second guide portion 65R are disposed between the first side plate 66L and the second side plate 66R in the right-left direction. The second guide portion 65R has a generally rectangular column shape extending in the front-rear direction. The second guide portion 65R has a first guide groove 65A and a second guide groove 65B and includes a plurality of, for example, two, rollers 65D.

The first guide groove 65A of the second guide portion 65R is recessed rightward relative to a left surface of the second guide portion 65R and extends in the front-rear direction. The first guide groove 65A has a generally rectangular shape in sectional view. The first guide groove 65A has an open front end that opens toward the front.

The second guide groove 65B of the second guide portion 65R is recessed rightward relative to a right inner surface defining the first guide groove 65A and extends in the front-rear direction. The second guide groove 65B has a generally rectangular shape in sectional view. The second guide groove 65B has a closed front end.

As depicted in FIGS. 7 and 10, the rollers 65D of the second guide portion 65R are disposed in a front end portion of the first guide groove 65A of the second guide portion 65R while being spaced apart from each other in the front-rear direction. The rollers 65D have a general disc shape and are rotatable on respective axes extending in the right-left direction. Upper end portions of the rollers 65D protrudes upward beyond a lower inner surface of the first guide groove 65A.

(5) Pressing Portions

As depicted in FIGS. 2 and 5, the first pressing portion 60L is disposed above the first guide portion 65L. The first pressing portion 60L is supported by a left end portion of the upper plate 67. The first pressing portion 60L includes a pressing lever 79, a plurality of, for example, four, link members 80, a rotating member 81, and a tension spring 82 (refer to FIG. 1).

The pressing lever 79 has a generally rectangular column shape extending in the front-rear direction. The pressing lever 79 includes a plurality of, for example, four, accommodating portions 79A, a plurality of, for example, four, pressing members 83, and a plurality of, for example, eight, compression springs 84.

The accommodating portions 79A are disposed above the urging portions 50 of the respective process cartridges 13. The accommodating portions 79A are spaced apart from each other in the front-rear direction. The accommodating portions 79A are recessed upward relative to a lower surface of the pressing lever 79 and extend in the front-rear direction. The accommodating portions 79A have a generally rectangular shape in side sectional view with its lower end opened.

The pressing members 83 are placed in the respective accommodating portions 79A. The pressing members 83 have a generally box shape with its upper end opened and extend in the front-rear direction.

The compression springs 84 include four front compression springs 84F and four rear compression springs 84F. The front compression springs 84F are disposed in a contracted state at front end portions of the respective accommodating portions 79A. The rear compression springs 84F are disposed in a contracted state at rear end portions of the accommodating portions 79A. The compression springs 84 are coil springs that contract and expand in the up-down direction. An upper end of each compression spring 84 is in contact with a lower surface of an upper wall of a corresponding one of the accommodating portions 79A. A lower end of each compression spring 84 is in contact with an upper surface of a lower wall of a corresponding one of the pressing members 83. Thus, each pair of front compression springs 84F and rear compression spring 84F urges a corresponding pressing member 83 downward. An urging force of a pair of front compression spring 84F and rear compression spring 84F is stronger than an urging force of a pair of compression springs 54 of the urging portion 50 of the process cartridge 13.

The link members 80 are disposed above the pressing lever 79 while being spaced apart from each other in the front-rear direction. Lower ends of the link members 80 are joined to an upper end portion of the pressing lever 79 such that the link members 80 are pivotable. Upper ends of the link members 80 are joined to the upper plate 67 such that the link members 80 are pivotable.

As depicted in FIG. 1, the rotating member 81 is disposed at a left end portion of an upper front end portion of the main body 2. The rotating member 81 includes a rotating shaft 81A, a first connecting portion 81B, and a second connecting portion 81C.

The rotating shaft 81A has a generally cylindrical column shape extending in the right-left direction. The rotating shaft 81A is rotatably supported by the first side plate 66L.

The first connecting portion 81B has a generally flat plate shape and extends rearward from the rotating shaft 81A.

The second connecting portion 81C has a generally flat plate shape and extends downward from the rotating shaft 81A. The second connecting portion 81C is rotatably connected with a front end portion of the pressing lever 79.

The tension spring 82 may be a coil spring that expands and contracts in the up-down direction. An upper end of the tension spring 82 is connected with the first connecting portion 81B. A lower end of the tension spring 82 is connected with a rear surface of the front cover 8. The tension spring 82 expands to a length longer than its natural length in response to movement of the front cover 8 from the closing position to the exposing position.

As depicted in FIG. 2, the second pressing portion 60R is disposed above the second guide portion 65R. The second pressing portion 60R is supported by a right end portion of the upper plate 67. The second pressing portion 60R has the same or similar configuration as the first pressing portion 60L, and therefore, a detailed description will be omitted.

4. PROCEDURES FOR DETACHING AND ATTACHING PROCESS CARTRIDGE (1) Detachment Procedure Hereinafter, a procedure for detaching a process cartridge 13 will be described. In the description below, in a case where the same or similar components operate or function in the same or similar manner, a description will be made on one of the same or similar components. In order to detach a process cartridge 13 from the main body 2, as depicted in FIG. 10, an operator moves the front cover 8 from the closing position to the exposing position.

In response to the movement of the front cover 8 from the closing position toward the exposing position, the translation cam 72 of the driving unit 63 moves frontward from the non-pressing position by an urging force of the compression spring 87 and the translation cam 76 of the electric supply unit 64 also moves frontward from the non-pressing position by an urging force of the compression spring 89.

Figure 9:
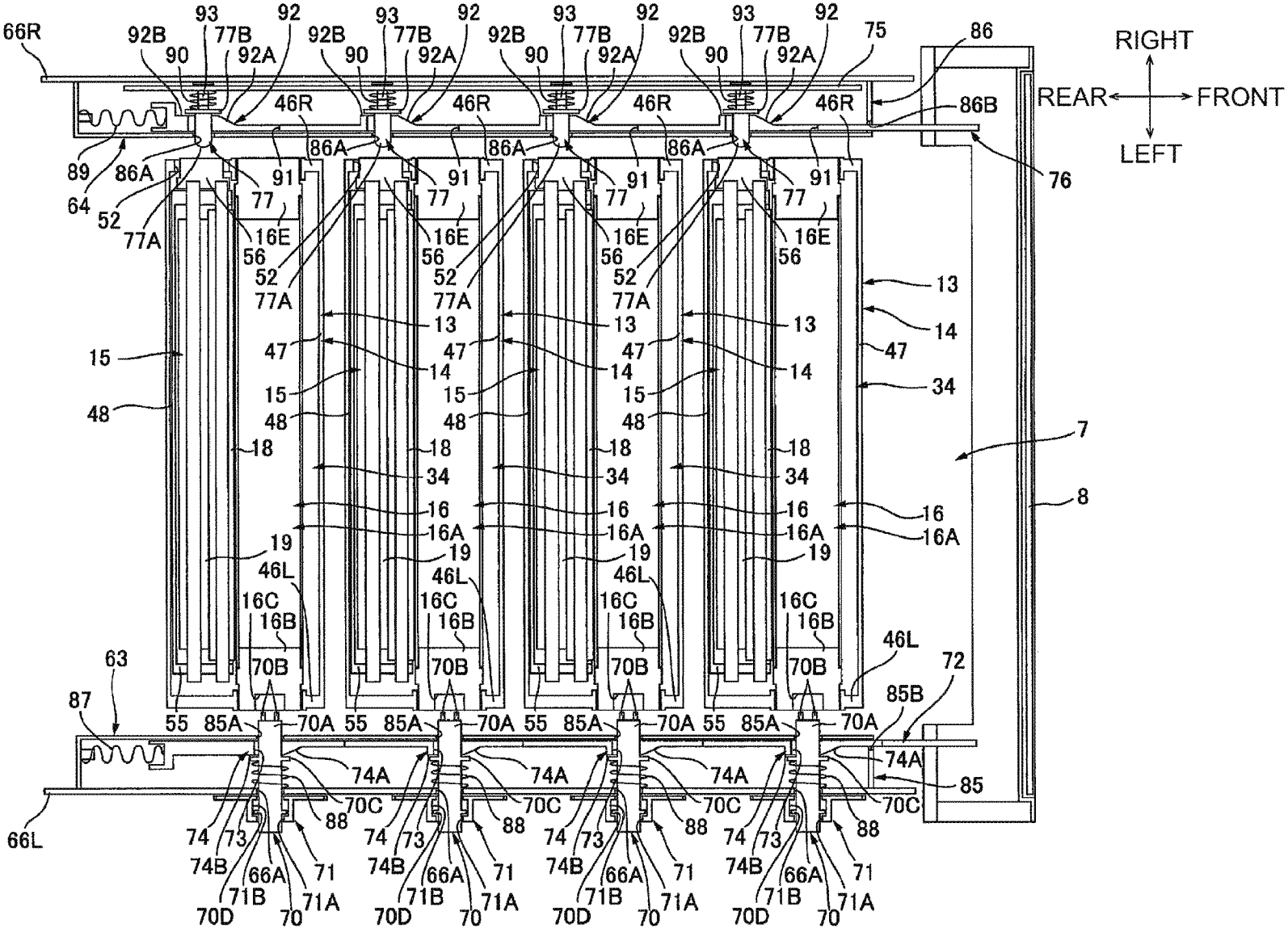
FIG. 9 is a sectional view taken along line C-C of the printer of FIG. 5 in the first illustrative embodiment according to one or more aspects of the disclosure, wherein a front cover is slightly tilted from a closing position toward an exposing position, translation cams are located at respective pressing positions, main-body couplings are located at an engaged position, and main-body electrodes are located at a contacting position.

When the front cover 8 is tilted toward the front slightly from the closing position, as depicted in FIG. 9, the translation cam 72 of the driving unit 63 is located at the pressing position and the translation cam 76 of the electric supply unit 64 is also located at the pressing position.

In response to the movement of the translation cam 72 from the non-pressing position to the pressing position, the main-body coupling 70 moves leftward from the engaged position such that the flange portion 70C slides over the inclined surface 74A of the position switching portion 74. Then, the flange portion 70*C comes* into contact with the parallel surface 74B of the position switching portion 74 and thus the main-body coupling 70 is located at the disengaged position.

In response to the movement of the translation cam 76 from the non-pressing position to the pressing position, the main-body electrode 77 moves rightward from the contacting position while the flange portion 77B slides over the inclined surface 92A of the position switching portion 92. Then, the flange portion 77B comes into contact with the parallel surface 92B of the position switching portion 92 and thus the main-body electrode 77 is located at the non-contacting position.

In this state, as depicted in FIG. 11, the main-body coupling 70 is located below the first side frame 41L with overlapping the first side frame 41L when projected in the up-down direction. Further, the second end portion E2 of the main-body coupling 70 protrudes rightward beyond the first guide portion 65L through the hole 85A of the frame 85 of the driving unit 63.

The main-body electrode 77 is located below the second side frame 41R with overlapping the second side frame 41R when projected in the up-down direction. Further, the second end portion E3 of the main-body electrodes 77 protrudes leftward beyond the second guide portion 65R through the hole 86A of the frame 86 of the electric supply unit 64.

Thereafter, as depicted in FIG. 10, the front cover 8 is further tilted toward the front. In response to this, the front cover 8 is further distanced from the translation cam 72 of the driving unit 63 and the translation cam 76 of the electric supply unit 64. Finally, the front cover 8 reaches the exposing position and is retained at the exposing position.

In response to the movement of the front cover 8 to the exposing position, the tension spring 82 is pulled downward and frontward.

Thus, the first connecting portion 81B is pulled downward and frontward by an urging force of the tension spring 82. Therefore, the rotating member 81 rotates counterclockwise on the rotating shaft 81A in left side view.

The pressing lever 79 is also pulled upward and frontward by the second connecting portion 81C and thus moves upward and frontward in a translation manner. In response to the translation of the pressing lever 79, the pressing member 83 moves upward and frontward to be separated from the urging portion 50.

In this state, in the urging portion 50 of the first side wall 46L, the contact member 53 is in contact with the upper surface of the first side frame 41L. Therefore, the accommodating member 40 of the first side wall 46L is urged upward relative to the contact member 53 by an urging force of the compression spring 54. In the urging portion 50 of the second side wall 46R, the contact member 53 is in contact with the upper surface of the second side frame 41R. Therefore, the accommodating member 40 of the second side wall 46R is urged upward relative to the contact member 53 by an urging force of the compression spring 54.

Accordingly, the process cartridge 13 moves upward from the first position to the second position by an urging force of the urging portion 50 of the first side wall 46L and an urging force of the urging portion 50 of the second side wall 46R. In response to the upward movement of the process cartridge 13 from the first position to the second position, the contact member 53 of the urging portion 50 of the first side wall 46L and the contact member 53 of the urging portion 50 of the second side wall 46R move from the retracted position to the protruding position relative to each other. In other words, the process cartridge 13 moves from the first position to the second position by a reaction force that occurs due to pressing of the upper surface of the first side frame 41L when the contact member 53 of the urging portion 50 of the first side wall 46L moves from the retracted position to the protruding position and a reaction force that occurs due to pressing of the upper surface of the second side frame 41R when the contact member 53 of the urging portion 50 of the second side wall 46R moves from the retracted position to the protruding position.

Then, as depicted in FIG. 11, the drum support portion 49 of the first side wall 46L of the process cartridge 13 is disengaged from the positioning recess 69A of the first positioning plate 69L and the drum support portion 49 of the second side wall 46R of the process cartridge 13 is also disengaged from the positioning recess 69A of the second positioning plate 69R. Meanwhile, the photosensitive drum 16 of the process cartridge 13 moves upward to be separated from the intermediate transfer belt 29 such that a uniform spacing is provided in the up-down direction between the photosensitive drum 16 and the intermediate transfer belt 29 across the right-left direction.

Then, as depicted in FIG. 8C, the operator turns the switching member 58 of the support frame 12 from the locking position to the unlocking position.

In response to this, the lock member 57 moves from the protruding position to the retracted position to disengage from the engagement portion 65C.

Figure 12:
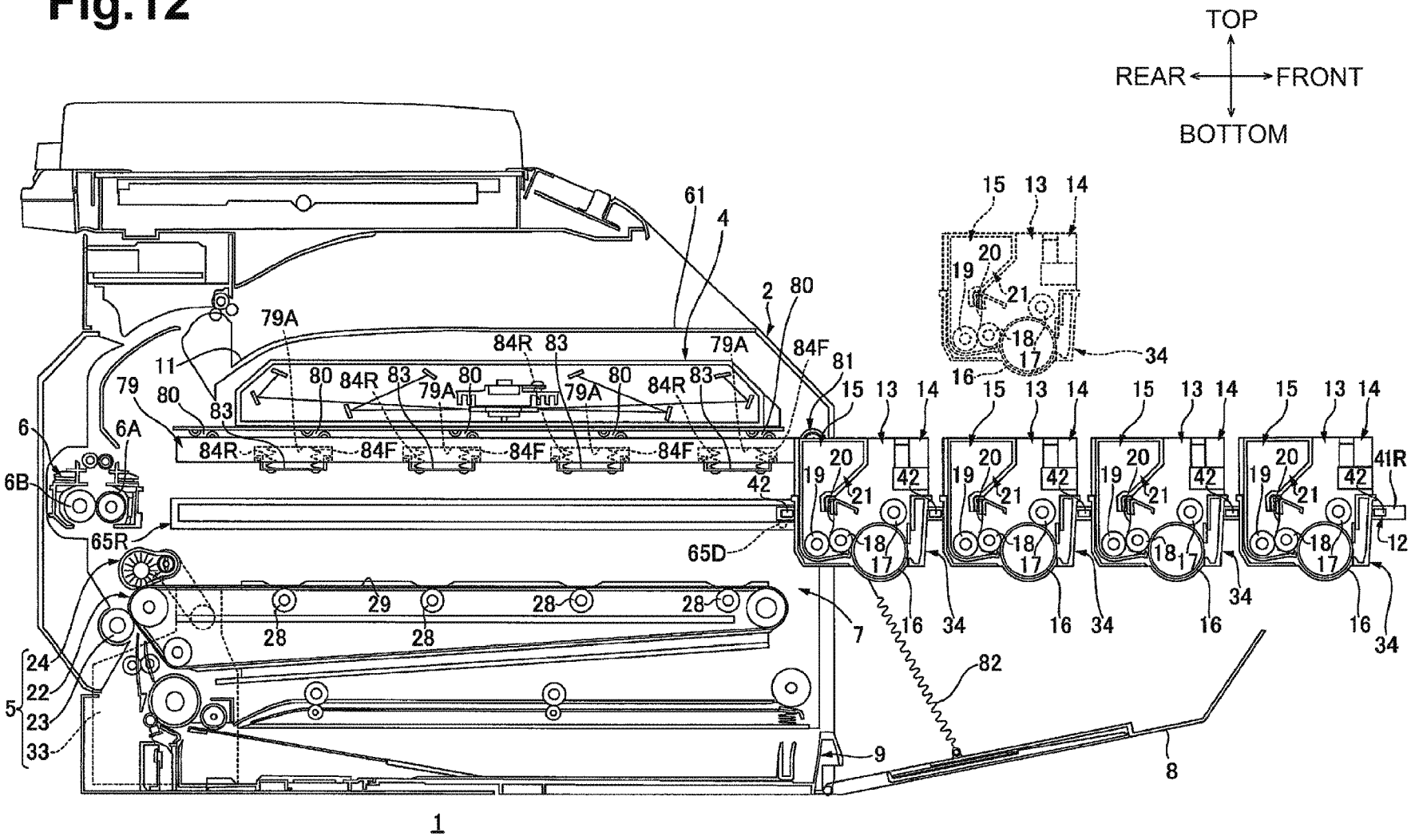
FIG. 12 is a sectional view depicting the printer in the first illustrative embodiment according to one or more aspects of the disclosure, wherein a process unit of FIG. 1 is drawn from the main body.

Then, as depicted in FIG. 12, the operator pulls frontward the support frame 12 supporting the process cartridges 13 from the main body 2 to locate the support frame 12 at the outside position.

Thereafter, as depicted by a dashed line in FIG. 12, the operator pulls the process cartridge 13 upward to detach the process cartridge 13 from the support frame 12.

Finally, the detachment of the process cartridge 13 from the main body 2 is completed.

(2) Attachment Procedure

Hereinafter, a procedure for attaching a process cartridge 13 will be described. In the description below, in a case where the same or similar components operate or function in the same or similar manner, a description will be made on one of the same or similar components. In order to attach a process cartridge 13 to the main body 2, the operator operates the printer 1 in a reverse order to the detachment procedure.

More specifically, the operator inserts the process cartridge 13 into a corresponding opening 12A of the support frame 12 from above. Thus, the process cartridge 13 is supported by the support frame 12.

Then, as depicted in FIG. 10, the operator moves the support frame 12 supporting the process cartridges 13 into the main body 2 to locate the support frame 12 at the inside position.

Thereafter, as depicted in FIG. 8B, the operator turns the switching member 58 of the support frame 12 from the unlocking position to the locking position.

In response to this, the lock member 57 moves from the retracted position to the protruding position to engage with the engagement portion 65C.

Then, the operator moves the front cover 8 from the exposing position toward the closing position.

In response to the movement of the front cover 8 from the exposing toward the closing position, the tension spring 82 is restored and thus the tension of the tension spring 82 decreases.

Therefore, the tension of the tension spring 82 also decreases and the rotating member 81 rotates clockwise on the rotating shaft 81A by an urging force of a coil spring (not depicted) in left side view.

In response to this, the pressing lever 79 is pressed downward and rearward by the second connecting portion 81C and moves downward and rearward in a translation manner. In response to the translation of the pressing lever 79, the pressing member 83 comes into contact with the upper surface of the urging portion 50 and thus the pressing member 83 presses the upper surface of the urging portion 50 downward.

Thus, the process cartridge 13 moves downward from the second position to the first position against an urging force of the compression spring 54 of the urging portion 50.

In response to the downward movement of the process cartridge 13, as depicted in FIG. 2, the drum support portion 49 of the process cartridge 13 comes into engagement with the positioning recess 69A and the photosensitive drum 16 of the process cartridge 13 comes into contact with the upper surface of the intermediate transfer belt 29.

Thereafter, the front cover 8 is further moved toward the closing position. In response to this, as depicted in FIG. 9, the front cover 8 comes into contact with the front end of the translation cam 72 of the driving unit 63 and the front end of the translation cam 76 of the electric supply unit 64 to press the translation cam 72 and the translation cam 76 rearward.

Thus, as depicted in FIG. 6, when the front cover 8 is located at the closing position, the translation cam 72 of the driving unit 63 is located at the non-pressing position and the translation cam 76 of the electric supply unit 64 is located at the non-pressing position.

In response to the movement of the translation cam 72 of the driving unit 63 from the pressing position to the non-pressing position, the main-body coupling 70 moves rightward from the disengaged position while the flange portion 70C slides over the inclined surface 74A of the position switching portion 74. Then, the main-body coupling 70 comes into engagement with the coupling recess 16C of the photosensitive drum 16 and thus the main-body coupling 70 is located at the engaged position.

In response to the movement of the translation cam 76 from the pressing position to the non-pressing position, the main-body electrode 77 moves leftward from the non-contacting position while the flange portion 77B slides over the inclined surface 92A of the position switching portions 92. Then, the main-body electrode 77 comes into contact with the developing electrode 56 of the process cartridges 13 and thus the main-body electrode 77 is located at the contacting position.

Therefore, the attachment of the process cartridge 13 to the main body 2 is completed. In this state, the front end portion of the pressing lever 79 is in contact with the rear surface of the front cover 8, whereby the pressing lever 79 is retained at the position.

Thereafter, a driving force is inputted to the drum drive gear 71 from a motor (not depicted) of the main body 2 and electric power supplied from the power supply board 75 is inputted into the developing electrode 56.

Thus, the drum drive gear 71 starts rotating and the main-body coupling 70 starts rotating integral with the drum drive gear 71. In response to this, the photosensitive drum 16 starts rotating on a rotating axis common to the main-body coupling 70 since the protruding portions 70B of the main-body coupling 70 are in contact with the protrusions 16D of the photosensitive drum 16.

Further, a predetermined electric power is supplied to the developing roller 18 and the supply roller 19 of the process cartridge 13.

5. CORRESPONDENCE BETWEEN FIRST ILLUSTRATIVE EMBODIMENT AND CLAIMED ELEMENTS

In the first illustrative embodiment, the up-down direction is an example of an orthogonal direction. The front-rear direction is an example of a sliding direction. The right-left direction is an example of an axial direction. The left is an example of one side in an axial direction. The right is an example of the other side in the axial direction. The printer 1 is an example of an image forming apparatus. Toner is an example of a developing agent. The toner image is an example of a developing agent image. The intermediate transfer belt 29 is an example of a transfer medium. The first flange member 16B of the photosensitive drum 16 is an example of a driving-force receiving member. The urging portion 50 of the first side wall 46L and the urging portion 50 of the second side wall 46R are an example of a pressed portion. The developing electrode 56 is an example of an electrode member. The main-body coupling 70 is an example of a driving-force input member. The main-body electrode 77 is an example of an electric supply member. The translation cam 72 of the driving unit 63 is an example of a first movable member. The non-pressing position of the translation cam 72 is an example of a first position. The pressing position of the translation cam 72 is an example of a second position. The translation cam 76 of the electric supply unit 64 is an example of a second movable member. The non-pressing position of the translation cam 76 is an example of the first position. The pressing position of the translation cam 76 is an example of the second position. The compression spring 54 is an example of an urging member.

6. EFFECTS (1) According to the printer 1 of the first illustrative embodiment, as depicted in FIG. 3, the first side frame 41L and the second side frame 41R of the support frame 12 that supports the process cartridges 13 each have the dimension in the up-down direction L1 that is less than or equal to the dimension in the right-left direction L2.

Therefore, the first side frame 41L and the second side frame 41R of the support frame 12 may be reduced in size in the up-down direction.

Due to the achievement of the size reduction in the first side frame 41L and the second side frame 41R of the support frame 12 in the up-down direction, as depicted in FIG. 11, the structural components of the main body 2, such as the first pressing portion 60L, the second pressing portion 60R, the driving unit 63, and the electric supply unit 64, and the structural components of the process cartridge 13, such as the urging portion 50, may be disposed in adjacent areas of the support frame 12 using spaces on both sides of the first side frame 41L in the up-down direction and spaces on both sides of the second side frame 41R in the up-down direction.

Accordingly, the printer 1 may be reduced in size.

Further, the weight of the first side frame 41L and the second side frame 41R may be reduced, thereby preventing the center of gravity of the main body 2 from being tilted frontward excessively when the support frame 12 is located at the outside position. Therefore, toppling of the main body 2 may be prevented or reduced when the support frame 12 is located at the outside position.

In a known printer, a support frame supports process cartridges by sandwiching the process cartridges between plate members extending in the up-down direction. Therefore, in order to reduce the size of the known printer in the right-left direction, generally, a thickness (e.g., a dimension in the right-left direction) of the plate members may be reduced.

In the printer 1 of the first illustrative embodiment, the dimension in the up-down direction L1 of the first side frame 41L and the dimension in the up-down direction L1 of the second side frame 41R are shortened to provide the spaces on the both sides of the first side frame 41L in the up-down direction and the spaces on the both sides of the second side frame 41R in the up-down direction. Through use of such spaces for arranging the structural components as described above, the above-described printer 1 may be further reduced in size than the known printer.

(2) According to the printer 1 of the first illustrative embodiment, as depicted in FIGS. 2 and 5, the dimension in the up-down direction L1 of the first side frame 41L and the dimension in the up-down direction L1 of the second side frame 41R may be between 5% and 30% inclusive (preferably, between 10% and 20% inclusive) of the dimension in the up-down direction L4 of the process cartridges 13. The left end portion of the process cartridge 13 is exposed from the first side frame 41L when viewed from the left. The right end portion of the process cartridge 13 is exposed from the second side frame 41R when viewed from the right.

Therefore, most of the left end portion and the right end portion of the process cartridge 13 (e.g., 70% or more of the dimension in the up-down direction, preferably, 90% or more of the dimension in the up-down direction) may be exposed from the first side frame 41L and the second side frame 41R, respectively.

With this configuration, the structural elements of the main body 2 may easily act on the left end portion and the right end portion of the process cartridge 13, which are uncovered by the first side frame 41L and the second side frame 41R.

(3) According to the printer 1 of the first illustrative embodiment, as depicted in FIG. 3, the first side frame 41L and the second side frame 41R have a generally rectangular column shape extending in the front-rear direction.

Accordingly, rigidity of the first side frame 41L and the second side frame 41R may be ensured with the simple configuration.

(4) According to the above-described printer 1, as depicted in FIGS. 2 and 5, the process cartridge 13 includes the lower portion 13A and the upper portion 13B. The lower portion 13A is disposed below the first side frame 41L and the second side frame 41R and supports the photosensitive drum 16 in the state where the process cartridge 13 is supported by the support frame 12. The upper portion 13B is disposed above the first side frame 41L and the second side frame 41R while the process cartridge 13 is supported by the support frame 12.

This configuration may enable to act the structural components of the main body 2, such as the main-body couplings 70 and the main-body electrodes 77, on the lower portion 13A located below the first side frame 41L and the second side frame 41R easily. This configuration may further enable to act the structural components of the main body 2, such as the first pressing portion 60L and the second pressing portion 60R, on the upper portion 13B located above the first side frame 41L and the second side frame 41R easily.

Accordingly, flexible arrangement of the structural components of the main body 2 that act on the process cartridge 13 may be ensured.

(5) According to the above-described printer 1 of the first illustrative embodiment, as depicted in FIG. 6, the process cartridge 13 has the coupling recess 16C in the left end portion of the lower portion 13A and the developing electrode 56 at the right end portion of the lower portion 13A.

Therefore, the process cartridge 13 receives a driving force from the main body 2 at the left side of the lower portion 13A and electric power from the main body 2 at the right side of the lower portion 13A.

Accordingly, when the process cartridge 13 receives a driving force and electric power from the main body 2, the process cartridge 13 may be stably positioned with respect to the right-left direction.

(6) According to the printer 1 of the first illustrative embodiment, as depicted in FIG. 2, the main body 2 includes the main-body coupling 70 located to the left of the process cartridge 13 and the main-body electrode 77 located to the right of the process cartridge 13.

Therefore, the main body 2 may input a driving force to the process cartridge 13 from the left of the process cartridge 13 while supplying electric power to the process cartridge 13 from the right of the process cartridge 13.

Accordingly, when a driving force and electric power are inputted to the process cartridge 13 from the main body 2, the process cartridge 13 may be retained stably.

This configuration may prevent or reduce interference of the main-body coupling 70 and the main-body electrode 77 with the process cartridge 13 when the support frame 12 is moved along the front-rear direction.

(7) According to the above-described printer 1, as depicted in FIG. 11, the second end portion E2 of the main-body coupling 70 is located between the first guide portion 65L and the second guide portion 65R when viewed in the up-down direction in the state where the main-body coupling 70 is located at the disengaged position.

Therefore, as depicted in FIGS. 2 and 11, the main-body coupling 70 may be movable between the engaged position and the disengaged position while the second end portion E2 is located between the first guide portion 65L and the second guide portion 65R when viewed in the up-down direction.

With this configuration, in the state where the main-body coupling 70 is located at the disengaged position, the moving distance of the main-body coupling 70 may be shortened as compared with a case where the second end portion E2 of the main-body coupling 70 is located closer to the left than the first guide portion 65L.

Accordingly, a less space may be required for moving the main-body coupling 70, whereby the size of the printer 1 may be reduced.

The second end portion E2 of the main-body coupling 70 overlaps the first side frame 41L when viewed in the up-down direction in the state where the main-body coupling 70 is located at the disengaged position.

Therefore, the main-body coupling 70 may be disposed effectively using the overlapping space in which the second end portion E2 of the main-body coupling 70 overlaps the first side frame 41L in the up-down direction.

(8) According to the printer 1 of the first illustrative embodiment, as depicted in FIG. 11, the translation cam 72 of the driving unit 63 overlaps the first side frame 41L when viewed in the up-down direction.

Therefore, the translation cam 72 may be disposed effectively using the overlapping space in which the translation cam 72 of the driving unit 63 overlaps the first side frame 41L in the up-down direction.

(9) According to the printer 1 of the first illustrative embodiment, as depicted in FIG. 11, the second end portion E3 of the main-body electrodes 77 is located between the first guide portion 65L and the second guide portion 65R when viewed in the up-down direction in the state where the main-body electrode 77 is located at the non-contacting position.

Therefore, the main-body electrode 77 may be movable between the contacting position and the non-contacting position in the state where the second end portion E3 is located between the first guide portion 65L and the second guide portion 65R when viewed in the up-down direction.

With this configuration, in the state where the main-body electrode 77 is located at the non-contacting position, the moving distance of the main-body electrode 77 may be shortened as compared with a case where the second end portion E3 of the main-body electrode 77 is located closer to the right than the second guide portion 65R.

Accordingly, a less space may be required for moving the main-body electrode 77, whereby the size of the printer 1 may be reduced.

The second end portion E3 of the main-body electrode 77 overlaps the second side frame 41R when viewed in the up-down direction in the state where the main-body electrode 77 is located at the non-contacting position.

Therefore, the main-body electrodes 77 may be disposed effectively using the overlapping space in which the second end portion E3 of the main-body electrode 77 overlaps the second side frame 41R in the up-down direction.

(10) According to the printer 1 of the first illustrative embodiment, as depicted in FIG. 11, the translation cam 76 of the electric supply unit 64 overlaps the second side frame 41R when viewed in the up-down direction.

Therefore, the translation cam 76 may be disposed effectively using the overlapping space in which the translation cam 76 of the electric supply unit 64 overlaps the second side frame 41R in the up-down direction.

(11) According to the printer 1 of the first illustrative embodiment, as depicted in FIG. 2, the first guide portion 65L and the second guide portion 65R are disposed between the first side plate 66L and the second side plate 66R in the right-left direction.

Accordingly, the support frame 12 may be supported securely between the first side plate 66L and the second side plate 66R.

(12) According to the above-described printer 1, as depicted in FIG. 2, the power supply board 75 may be disposed effectively between the second side plate 66R and the main-body electrodes 77.

(13) According to the printer 1 of the first illustrative embodiment, as depicted in FIG. 5, the dimension in the up-down direction L1 of the first side frame 41L and the dimension in the up-down direction L1 of the second side frame 41R are smaller than the dimension in the up-down direction L4 of the coupling recess 16C.

Therefore, the first side frame 41L and the second side frame 41R may have a smaller dimension in the up-down direction than the coupling recess 16C.

Thus, more spaces may be ensured on the both sides of the first side frame 41L in the up-down direction and on the both sides of the second side frame 41R in the up-down direction.

Accordingly, the first pressing portion 60L, the second pressing portion 60R, the driving unit 63, and the electric supply unit 64 may be disposed further effectively in the adjacent areas of the support frame 12 using the spaces on the both sides of the first side frame 41L in the up-down direction and the spaces on the both sides of the second side frame 41R in the up-down direction.

(14) According to the above-described printer 1, as depicted in FIG. 3, the support frame 12 further includes the beam members 42 that connect the first side frame 41L and the second side frame 41R.

Accordingly, rigidity of the support frame 12 in the right-left direction may be ensured by the beam members 42.

(15) According to the printer 1 of the first illustrative embodiment, as depicted in FIG. 3, the first side frame 41L and the second side frame 41R each have the engagement holes 45 with which the beam members 42 are engaged.

Therefore, the rigidity of the support frame 12 may be ensured in the right-left direction with the simple configuration in which the beam members 42 are engaged with the respective engagement holes 45 of the first side frame 41L and the respective engagement holes 45 of the second side frame 41R.

(16) According to the printer 1 of the first illustrative embodiment, as depicted in FIG. 2, the first pressing portion 60L of the main body 2 presses the urging portion 50 of the first side wall 46L. The second pressing portion 60R of the main body 2 presses the urging portion 50 of the second side wall 46R. The urging portion 50 of the first side wall 46L overlaps the first side frame 41L in the up-down direction. The urging portion 50 of the second side wall 46R overlaps the second side frame 41R in the up-down direction.

Therefore, the urging portion 50 of the first side wall 46L and the urging portion 50 of the second side wall 46R may be disposed effectively using the overlapping space in which the urging portion 50 of the first side wall 46L overlaps the first side frame 41L in the up-down direction and the overlapping space in which the urging portion 50 of the second side wall 46R overlaps the second side frame 41R in the up-down direction.

A pressing force of the first pressing portion 60L is applied on the urging portion 50 of the first side wall 46L from above and a reaction force from the first side frame 41L acts on the urging portion 50 of the first side wall 46L from below. A pressing force of the second pressing portion 60R is applied on the urging portion 50 of the second side wall 46R from above and a reaction force from the second side frame 41R acts on the urging portion 50 of the second side wall 46R from below.

Accordingly, the process cartridge 13 may be retained securely in the up-down direction.

(17) According to the printer 1 of the first illustrative embodiment, as depicted in FIG. 9, the main-body coupling 70 and the coupling recess 16C are disengaged from each other in the middle of the movement of the front cover 8 from the closing position to the exposing position. Then, as depicted in FIG. 10, in the state where the main-body coupling 70 and the coupling recess 16C are disengaged from each other, the pressing of the first pressing portion 60L against the urging portion 50 of the first side wall 46L is released and the pressing of the second pressing portion 60R against the urging portion 50 of the second side wall 46R is released.

Therefore, in the state where the main-body coupling 70 and the coupling recess 16C are disengaged from each other, the process cartridge 13 may be moved from the first position to the second position.

Accordingly, the process cartridge 13 may be moved from the first position to the second position smoothly.

7. VARIATION OF SUPPORT FRAME

Hereinafter, referring to FIGS. 13A and 13B, examples of variations of the support frame will be described. An explanation will be given mainly for the parts different from the first illustrative embodiment, and an explanation will be omitted for the common parts by assigning the same reference numerals thereto.

(1) Outline of Variation of Support Frame

In the above-described support frame 12 of the first illustrative embodiment, the first side frame 41L, the second side frame 41R, and the beam members 42 define the openings 12A into which the respective process cartridges 13 are inserted. The first side frame 41L, the second side frame 41R, and the beam members 42 all have a generally bar shape.

Figure 13A:
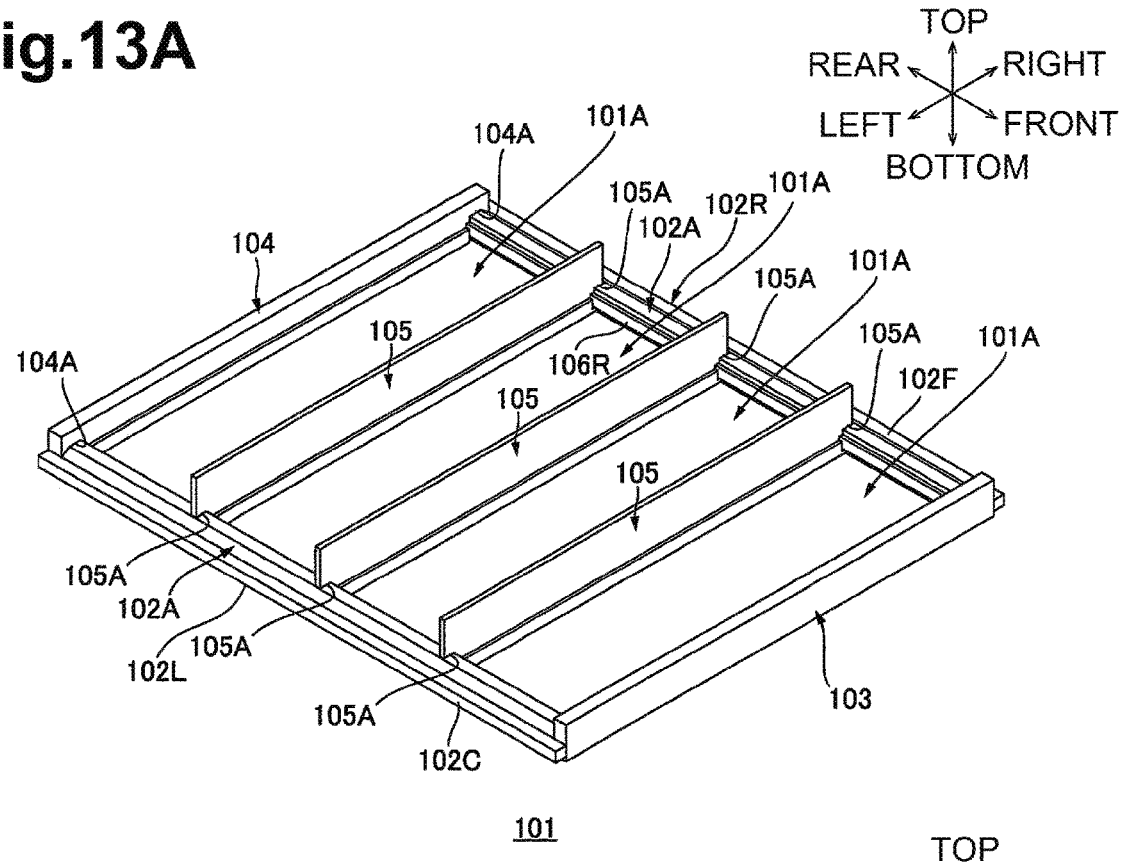
FIG. 13A is an upper front perspective view depicting a support frame in a variation of the first illustrative embodiment according to one or more aspects of the disclosure.

In one example of the variation, as depicted in FIG. 13A, in a support frame 101, a first side frame 102L, a second side frame 102R, and partition members 105 define openings 101A. The first side frame 102L and the second side frame 102R have a generally bar shape, and the partition members 105 have a generally flat plate shape.

(2) Details of Variation of Support Frame

Figure 13B:
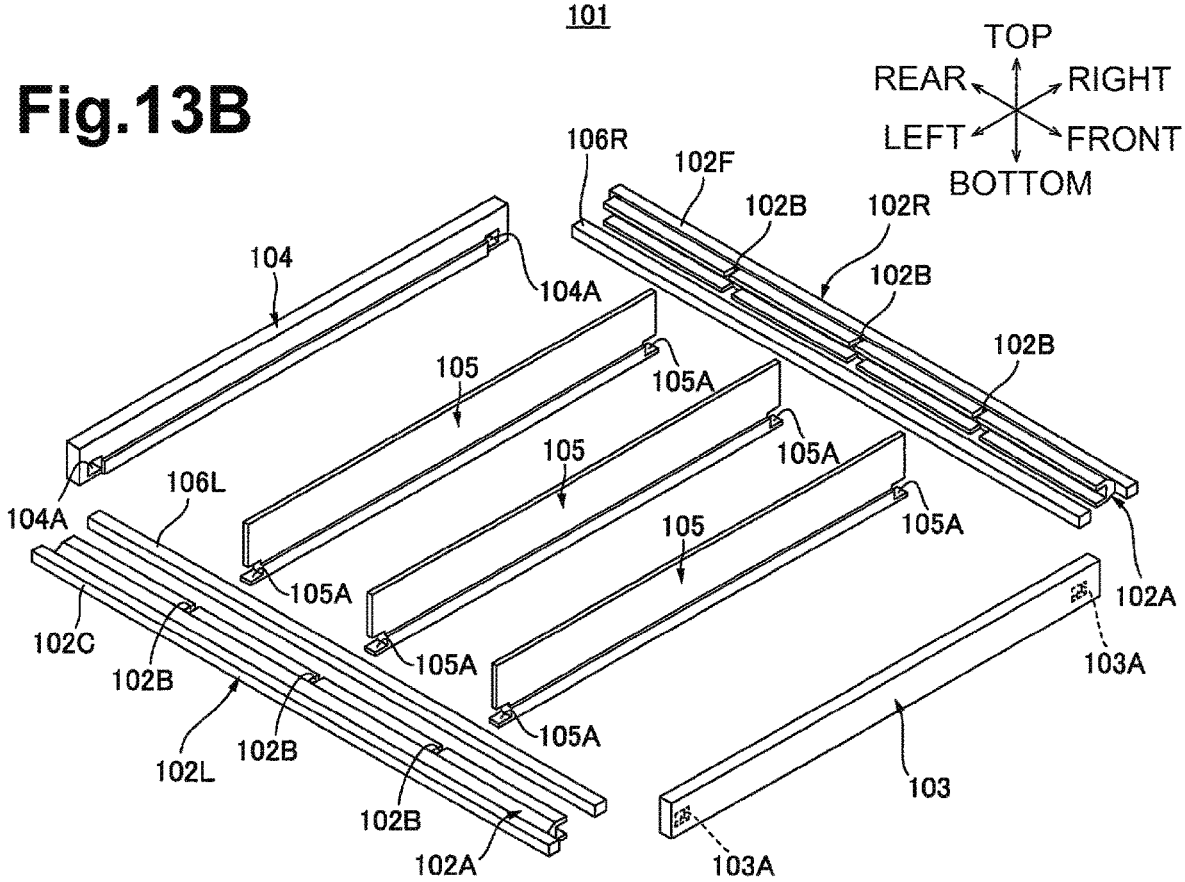
FIG. 13B is a disassembled upper front perspective view depicting the support frame of FIG. 13A in the variation of the first illustrative embodiment according to one or more aspects of the disclosure.

As depicted in FIGS. 13A and 13B, a support frame 101 includes a first side frame 102L, a second side frame 102R, a first reinforcing member 106L, a second reinforcing member 106R, a front beam 103, a rear beam 104, and a plurality of, for example, three, partition members 105.

The first side frame 102L defines a left end of the support frame 101. The first side frame 102L may have a generally bar shape extending in the front-rear direction, and more specifically, have a generally rectangular column shape. The first side frame 102L may be made of a hard resin material. The first side frame 102L includes an accommodating portion 102A, a plurality of slits 102B, and a first guided portion 102C.

The accommodating portion 102A of the first side frame 102L is disposed at a right end portion of the first side frame 102L. The accommodating portion 102A extends in the front-rear direction and has a generally rectangular cylindrical shape with its right end opened. The accommodating portion 102A is disposed closer to the right than the first guide groove 65A of the first guide portion 65L. An upper surface of the accommodating portion 102A is configured to come into contact with the contact member 53 of the first side wall 46L of the process cartridge 13.

The plurality of slits 102B of the first side frame 102L includes three slits 102B defined in an upper wall of the accommodating portion 102A and three slits 102B defined in a lower wall of the accommodating portion 102A. The slits 102B defined in the upper wall of the accommodating portion 102A are spaced apart from each other in the front-rear direction so as to divide an area of the upper wall of the accommodating portion 102A into four equal areas in the front-rear direction. The slits 102B defined in the upper wall of the accommodating portion 102A of the first side frame 102L are recessed leftward relative to a right end of the upper wall of the accommodating portion 102A. The slits 102B defined in the lower wall of the accommodating portion 102A are spaced apart from each other in the front-rear direction so as to divide an area of the lower wall of the accommodating portion 102A into four equal areas in the front-rear direction. The slits 102B defined in the lower wall of the accommodating portion 102A of the first side frame 102L are recessed leftward relative to a right end of the lower wall of the accommodating portion 102A.

The first guided portion 102C of the first side frame 102L is disposed at a left end portion of the first side frame 102L. The first guided portion 102C extends in the front-rear direction and has a generally rectangular column shape. The first guided portion 102C is engaged in the first guide groove 65A of the first guide portion 65L.

The second side frame 102R defines a right end of the support frame 101. The second side frame 102R may have a generally bar shape extending in the front-rear direction, and more specifically, have a generally rectangular column shape. The second side frame 102R may be made of a hard resin material. The second side frame 102R includes an accommodating portion 102A, a plurality of slits 102B, and a second guided portion 102F.

The accommodating portion 102A of the second side frame 102R is disposed at a left end portion of the second side frame 102R. The accommodating portion 102A extends in the front-rear direction has a generally rectangular cylindrical shape with its left end opened. The accommodating portion 102A is disposed closer to the left than the first guide groove 65A of the second guide portion 65R. An upper surface of the accommodating portion 102A is configured to come into contact with the contact member 53 of the second side wall 46R of the process cartridges 13.

The plurality of slits 102B of the second side frame 102R includes three slits 102B defined in an upper wall of the accommodating portion 102A and three slits 102B defined in a lower wall of the accommodating portion 102A. The slits 102B defined in the upper wall of the accommodating portion 102A are spaced apart from each other in the front-rear direction so as to divide an area of the upper wall of the accommodating portion 102A into four equal areas in the front-rear direction. The slits 102B defined in the upper wall of the accommodating portion 102A of the second side frame 102R are recessed rightward relative to a left end of the upper wall of the accommodating portion 102A. The slits 102B defined in the lower wall of the accommodating portion 102A are spaced apart from each other in the front-rear direction so as to divide an area of the lower wall of the accommodating portion 102A into four equal areas in the front-rear direction. The slits 102B defined in the lower wall of the accommodating portion 102A of the first side frame 102R are recessed rightward relative to a left end of the lower wall of the accommodating portion 102A.

The second guided portion 102F of the second side frame 102R is disposed at a right end portion of the second side frame 102R. The second guided portion 102F extends in the front-rear direction and has a generally rectangular column shape. The second guided portion 102F is engaged in the first guide groove 65A of the second guide portion 65R.

The first reinforcing member 106L is fitted in the accommodating portion 102A of the first side frame 102L. The first reinforcing member 106L has a generally bar shape extending in the front-rear direction, and more specifically, has a generally rectangular column shape. The first reinforcing member 106L may be made of a metallic material having a higher stiffness, for example, stainless.

The second reinforcing member 106R is fitted in the accommodating portion 102A of the second side frame 102R. The second reinforcing member 106R has a generally bar shape extending in the front-rear direction, and more specifically, has a generally rectangular column shape. The second reinforcing member 106R may be made of a metallic material having a higher stiffness, for example, stainless.

The front beam 103 defines a front end of the support frame 101. The front beam 103 has a generally flat plate shape extending in the right-left direction and in the up-down direction. An upper end of the front beam 103 is located higher than an upper end of the first side frame 102L and an upper end of the second side frame 102R. The front beam 103 has a plurality of, for example, two, engagement holes 103A.

One (e.g., the left engagement hole 103A) of the engagement holes 103A is defined in a left end portion of the front beam 103 and the other (e.g., the right engagement hole 103A) of the engagement holes 103A is defined in a right end portion of the front beam 103. The engagement holes 103A are recessed frontward relative to a rear surface of the front beam 103. The engagement holes 103A have a generally rectangular shape in front view. The left end portion of the front beam 103 is engaged with the front end portion of the first reinforcing member 106L via the left engagement hole 103A. The right end portion of the front beam 103 is engaged with the front end portion of the second reinforcing member 106R via the right engagement hole 103A.

The rear beam 104 defines a rear end of the support frame 101. The rear beam 104 has a generally flat plate shape in the right-left direction and in the up-down direction. An upper end of the rear beam 104 is located higher than the upper end of the first side frame 102L and the upper end of the second side frame 102R. The rear beam 104 has a plurality of, two, engagement holes 104A.

One (e.g., the left engagement hole 104A) of the engagement holes 104A is defined in a left end portion of the rear beam 104 and the other (e.g., the right engagement hole 104A) of the engagement holes 104A is defined in a right end portion of the rear beam 104. The engagement holes 104A are recessed rearward relative to a front surface of the rear beam 104. The engagement holes 104A have a generally rectangular shape. The left end portion of rear beam 104 is engaged with the rear end portion of the first reinforcing member 106L via the left engagement hole 104A. The right end portion of the rear beam 104 is engaged with the rear end portion of the second reinforcing member 106R via the right engagement hole 104A.

The partition members 105 are disposed between the front beam 103 and the rear beam 104 in the front-rear direction while being spaced apart from each other in the front-rear direction. The partition members 105 have a generally flat plate shape in the right-left direction. Upper ends of the partition members 105 are located higher than the upper ends of the front beam 103 and the rear beam 104. The partition members 105 are engaged with the respective slits 102B. The partition members 105 each have two cutouts 105A.

One (e.g., the left cutout 105A) of the cutouts 105A is defined in a left end portion of a corresponding partition member 105 and is recessed rightward relative to a left end of the corresponding partition member 105. The other of the cutouts 105A (e.g., the right cutout 105A) is defined in a right end portion of the corresponding partition member 105 and is recessed leftward relative to a right end of the corresponding partition member 105. The left cutout 105A is engaged with the first reinforcing member 106L. The right cutout 105A is engaged with the second reinforcing member 106R.

(3) Correspondence Between Variation and Claimed Elements

In the support frame of the above-described variation, the accommodating portion 102A of the first side frame 102L is an example of a first cartridge-support portion. The accommodating portion 102A of the second side frame 102R is an example of a second cartridge-support portion. The partition member 105 is an example of a beam member.

(4) Effects (4-1) According to the support frame 101 of the above-described variation, as depicted in FIGS. 13A and 13B, the support frame 101 includes the first reinforcing member 106L, which extends along the first side frame 102L in the front-rear direction, and the second reinforcing member 106R, which extends along the second side frame 102R in the front-rear direction.

Therefore, the rigidity of the support frame 101 in the front-rear direction may be ensured by the first reinforcing member 106L and the second reinforcing member 106R while the support frame 101 may be reduced in size.

Accordingly, the above-described configuration may prevent or reduce the warping of the support frame 101 that may be caused when the support frame 101 is located at the outside position.

(4-2) According to the support frame 101 of the above-described variation, as depicted in FIGS. 13A and 13B, the partition members 105 each have the cutout 105A for engaging with the first reinforcing member 106L and the cutout 105A for engaging with the second reinforcing member 106R.

Therefore, the rigidity of the support frame 101 in the front-rear direction may be ensured by the simple configuration in which the partition members 105 are engaged with the first reinforcing member 106L and the second reinforcing member 106R.

(4-3) According to the support frame 101 of the above-described variation, the effects that are the same as the effects obtained in the first illustrative embodiment may be obtained.

8. SECOND ILLUSTRATIVE EMBODIMENT

Referring to FIGS. 14, 15, 16, 17, and 18, a second illustrative embodiment will be described. An explanation will be given mainly for the parts different from the first illustrative embodiment, and an explanation will be omitted for the common parts by assigning the same reference numerals thereto.

(1) Overview of Second Illustrative Embodiment

In the first illustrative embodiment, the process cartridge 13 includes the urging portion 50 of the first side wall 46L and the urging portion 50 of the second side wall 46R. The process cartridge 13 is configured to move from the first position to the second position due to application of the reaction force that is caused by pressing of the first side frame 41L of the support frame 12 by the urging portion 50 of the first side wall 46L and the reaction force that is caused by pressing of the second side frame 41R of the support frame 12 by the urging portion 50 of the second side wall 46R.

Figure 14:
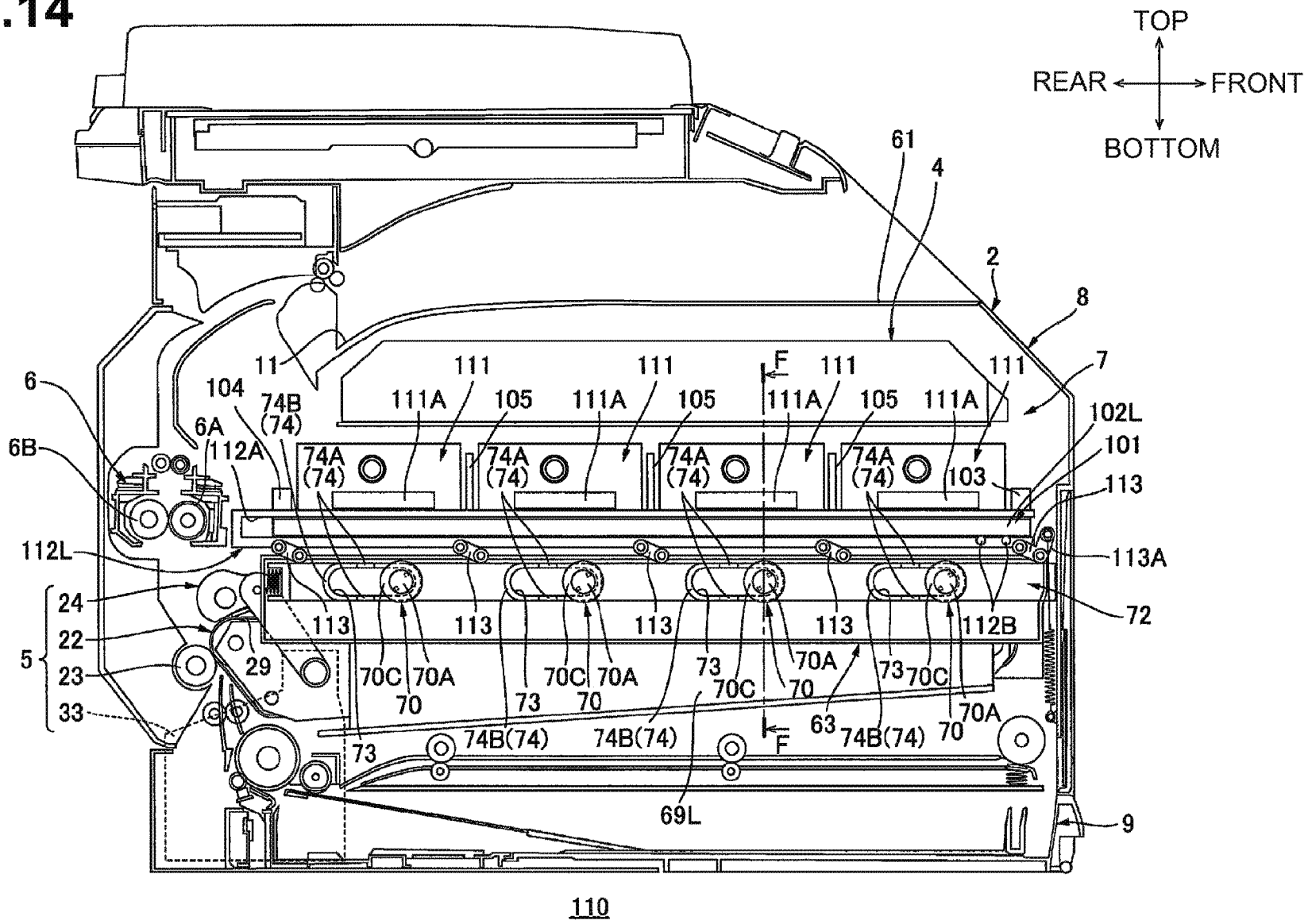
FIG. 14 is a sectional view depicting a printer in a second illustrative embodiment according to one or more aspects of the disclosure.
Figure 17:
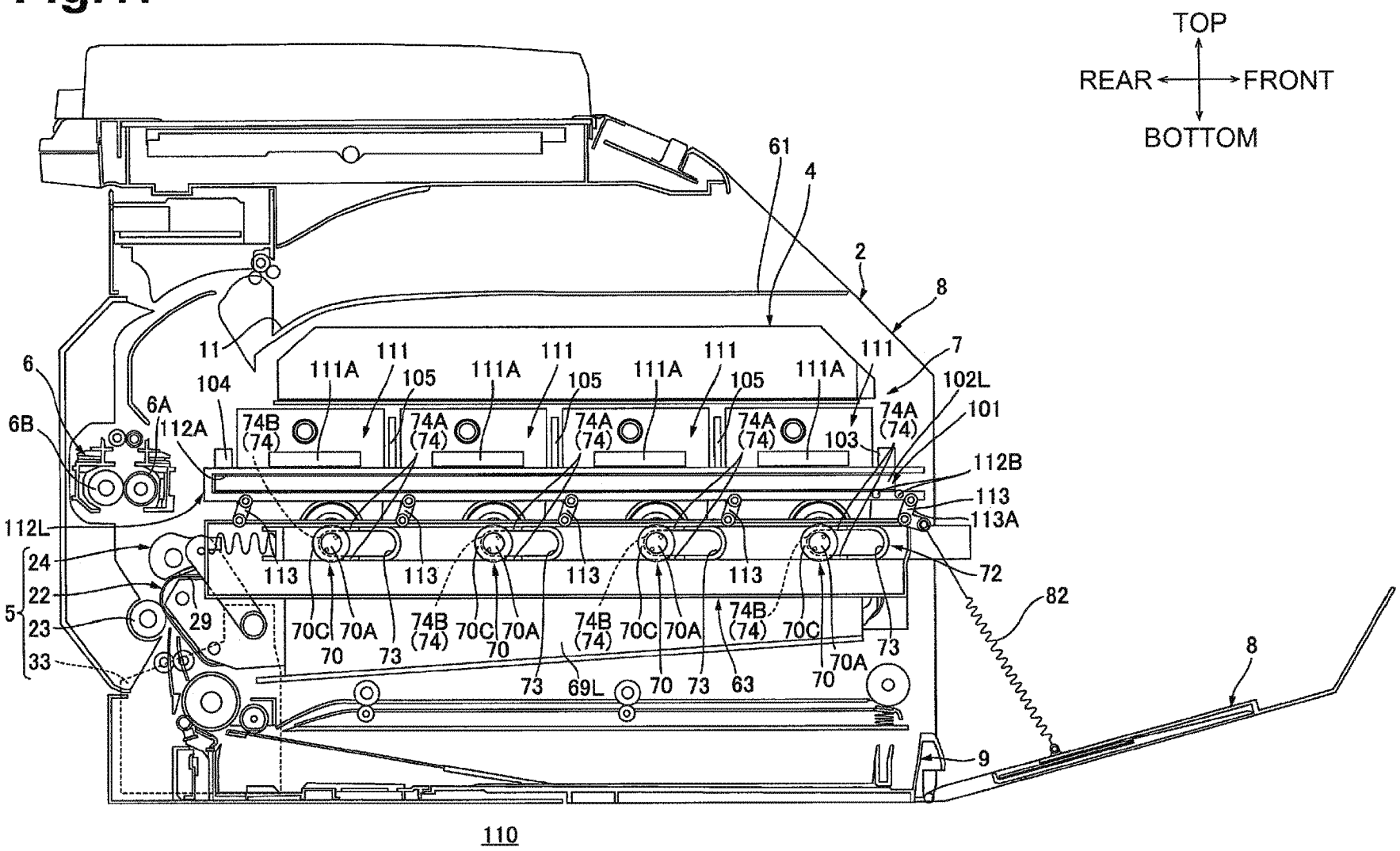
FIG. 17 is a sectional view depicting the printer of FIG. 14 in the second illustrative embodiment according to one or more aspects of the disclosure, wherein the front cover is located at the exposing position and the process cartridges are located at the second position.

In the second illustrative embodiment, as depicted in FIGS. 14 and 17, a process cartridge 111 has no urging portion 50. A first guide portion 112L and a second guide portion 112R are configured to move upward in synchronization with opening of the front cover 8.

The process cartridge 111 is configured to be moved from the first position to the second position together with the support frame 101 by the first guide portion 112L and the second guide portion 112R.

(2) Details of Second Illustrative Embodiment

Figure 16:
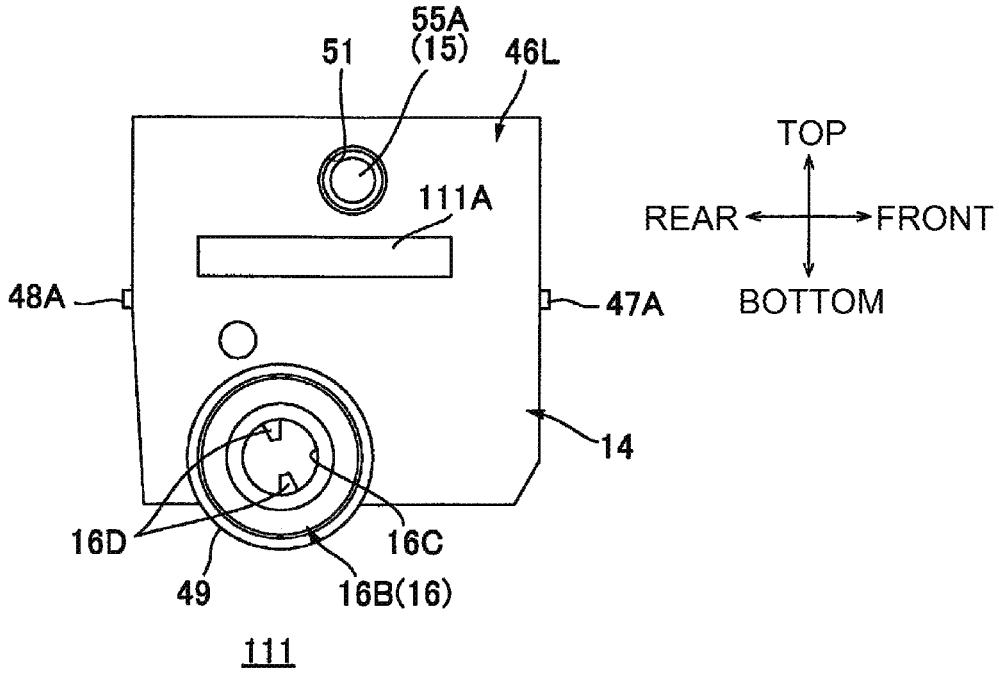
FIG. 16 is a left side view depicting a process cartridge of FIG. 14.

In the second illustrative embodiment, as depicted in FIG. 16, a process cartridge 111 has a configuration similar to the process cartridge 13 of the first illustrative embodiment except that the process cartridge 111 includes a projecting portion 111A, instead of the urging portion 50.

The projecting portion 111A is disposed at a substantially middle portion of the first side wall 46L in the up-down direction. The projecting portion 111A protrudes leftward from a left surface of the first side wall 46L. The projecting portion 111A has a generally rectangular column shape in the front-rear direction. The projecting portion 111A is also provided at the second side wall 46R.

In the second illustrative embodiment, as depicted in FIGS. 14 and 17, a printer 110 have no first pressing portion 60L nor second pressing portion 60R. The printer 110 has a configuration similar to the printer 1 of the first illustrative embodiment except that the first guide portion 112L and the second guide portion 112R are movable in the up-down direction in the printer 110 and the printer 110 includes the support frame 101 of the above-described variation.

Figure 15:
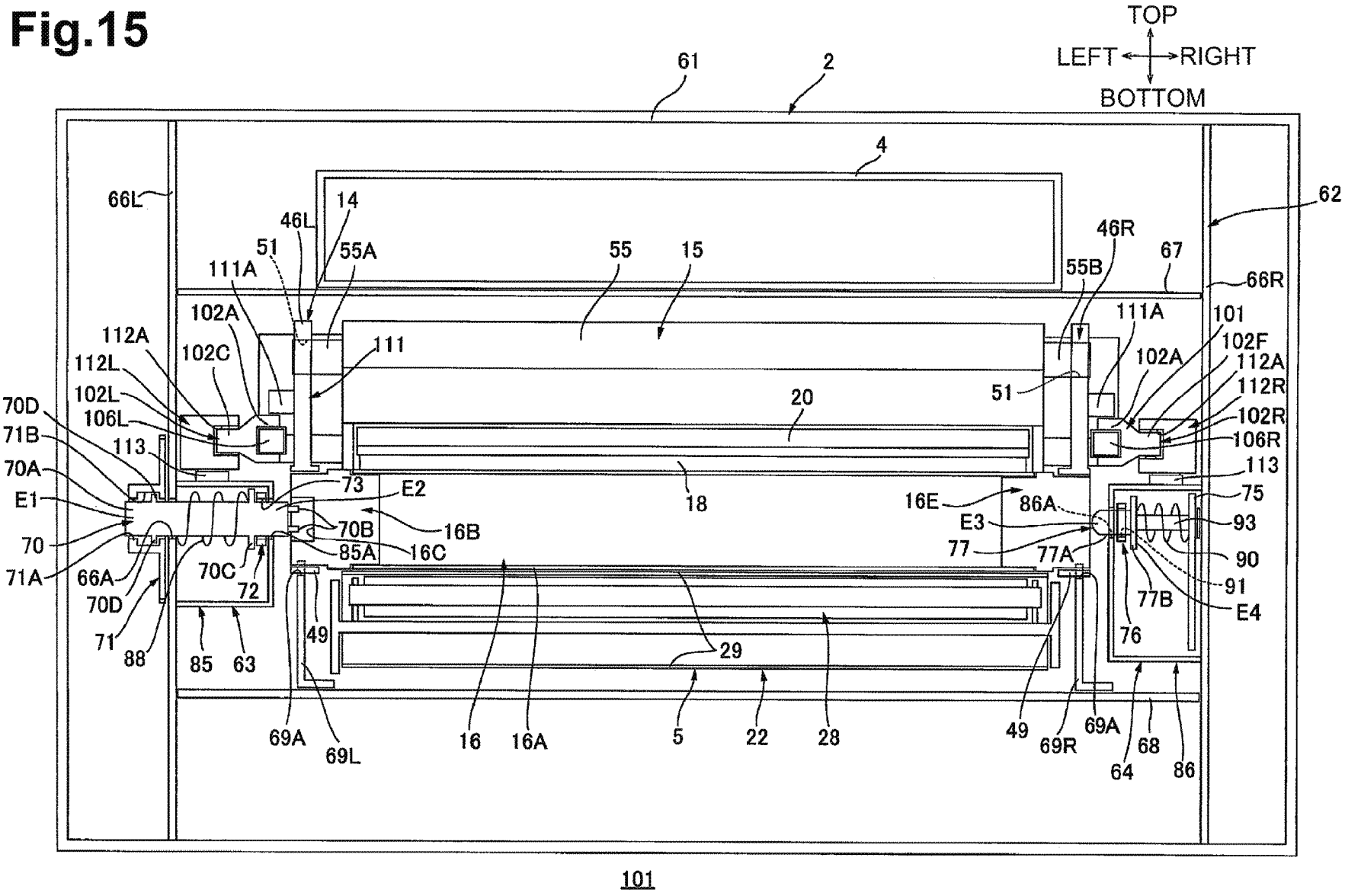
FIG. 15 is a sectional view taken along line F-F of the printer of FIG. 14 in the second illustrative embodiment according to one or more aspects of the disclosure.

As depicted in FIGS. 14 and 15, the first guide portion 112L is disposed above the driving unit 63. The first guide portion 112L has a generally rectangular column shape extending in the front-rear direction. The first guide portion 112L has a guide groove 112A and includes a plurality of, two, rollers 112B, and a plurality of, four, link members 113.

The guide groove 112A of the first guide portion 112L is recessed leftward relative to a right surface of the first guide portion 112L and extends in the front-rear direction. The guide groove 112A has a generally rectangular shape in sectional view. The guide groove 112A has an open front end.

The rollers 112B of the first guide portion 112L are disposed in a front end portion of the guide groove 112A of the first guide portion 112L and are spaced apart from each other in the front-rear direction. The rollers 112B have a generally disc shape and are rotatable on respective axes extending in the right-left direction. Upper end of the rollers 112B protrude upward relative to a lower inner surface of the guide groove 112A.

The link members 113 of the first guide portion 112L are spaced apart from each other in the front-rear direction while being disposed below the first guide portion 112L. Upper end portions of the link members 113 are connected to respective portions of a lower end portion of the first guide portion 112L such that the link members 113 are rotatable. Lower end portions of the link members 113 are connected to respective portions of an upper wall of the driving unit 63 such that the link members 113 are rotatable. The frontmost link member 113 includes a connecting portion 113A.

The connecting portion 113A of the first guide portion 112L has a generally flat plate shape and extends frontward from a lower end portion of the frontmost link member 113. The connecting portion 113A is connected with an upper end of the tension spring 82 disposed to the left of the connecting portion 113A.

The second guide portion 112R is disposed above the electric supply unit 64. The second guide portion 112R has a generally rectangular column shape extending in the front-rear direction. The second guide portion 112R has a guide groove 112A and includes a plurality of, two, rollers 112B, and a plurality of, four, link members 113.

The guide groove 112A of the second guide portion 112R is recessed rightward relative to a left surface of the second guide portion 112R and extends in the front-rear direction. The guide groove 112A has a generally rectangular shape in sectional view. The guide groove 112A has an open front end.

The rollers 112B of the second guide portion 112R are disposed in a front end portion of the guide groove 112A of the second guide portion 112R and are spaced apart from each other in the front-rear direction. The rollers 112B have a generally disc shape and are rotatable on respective axes extending in the right-left direction. Upper end of the rollers 112B protrude upward relative to a lower inner surface of the guide groove 112A.

The link members 113 of the second guide portion 112R are spaced apart from each other in the front-rear direction while being disposed below the second guide portion 112R. Upper end portions of the link members 113 are connected to respective portions of a lower end portion of the second guide portion 112R such that the link members 113 are rotatable. Lower end portions of the link members 113 are connected to respective portions of an upper wall of the electric supply unit 64 such that the link members 113 are rotatable. The frontmost link member 113 includes a connecting portion 113A.

The connecting portion 113A of the second guide portion 112R has a generally flat plate shape and extends frontward from a lower end portion of the frontmost link member 113. The connecting portion 113A is connected with an upper end of the other tension spring 82 disposed to the right of the connecting portion 113A.

(3) Procedures for Detaching and Attaching Process Cartridge in Second Illustrative Embodiment In the second illustrative embodiment, in order to detach a process cartridge 111 from the main body 2, as depicted in FIG. 17, the operator moves the front cover 8 from the closing position to the exposing position in a similar manner to the first illustrative embodiment. In the description below, in a case where the same or similar components operate or function in the same or similar manner, a description will be made on one of the same or similar components.

When the front cover 8 is tilted toward the front slightly from the closing position, similar to the first illustrative embodiment, the translation cam 72 of the driving unit 63 is located at the pressing position and a translation cam 76 of the electric supply unit 64 is located at the pressing position.

Thus, the main-body coupling 70 is located at the disengaged position and the main-body electrode 77 is located at the non-contacting position.

Figure 18:
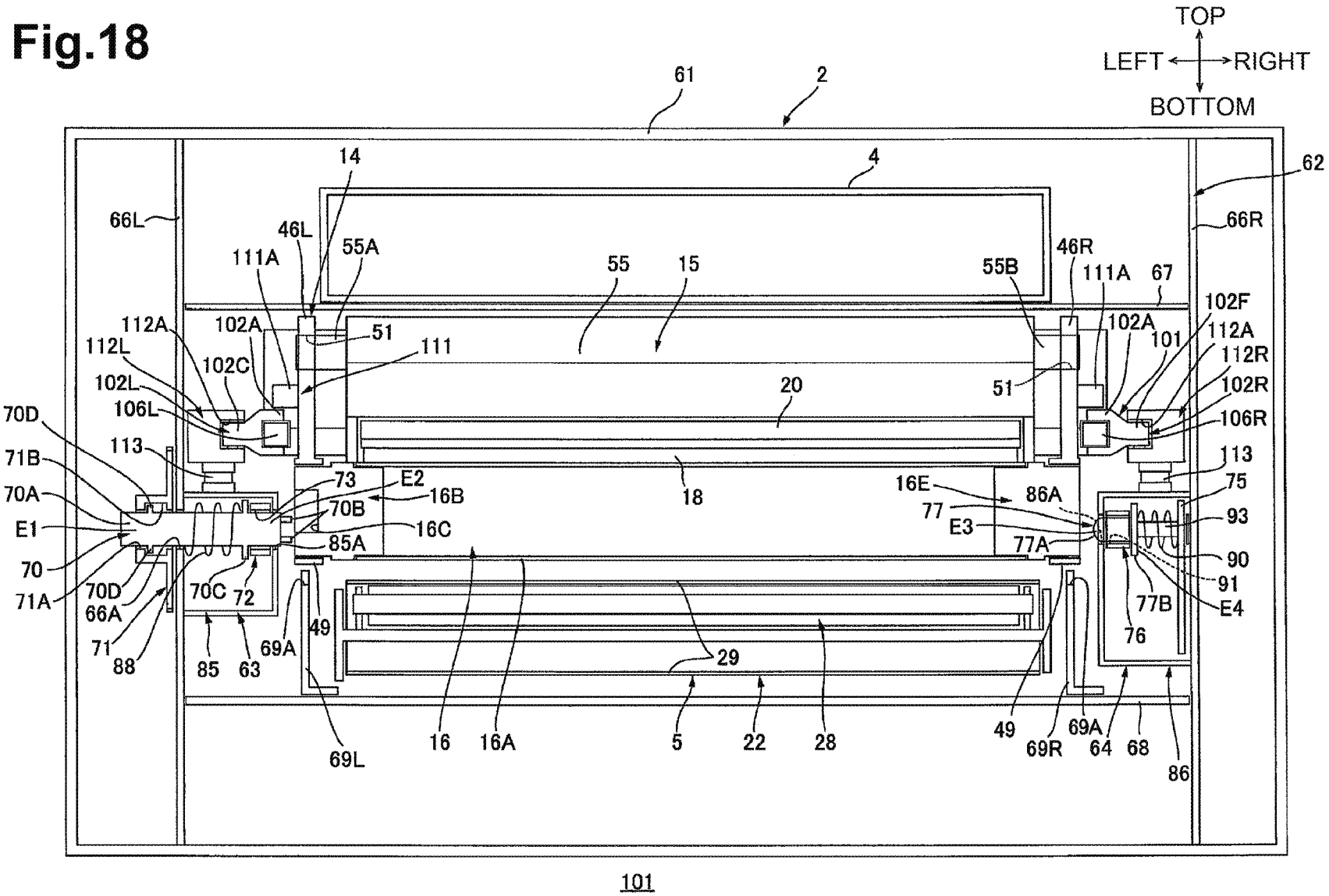
FIG. 18 is a sectional view taken along line F-F of the printer of FIG. 14 in the second illustrative embodiment according to one or more aspects of the disclosure, wherein the front cover is located at the exposing position and the process cartridge is located at the second position.

In this state, as depicted in FIG. 18, the main-body coupling 70 is disposed below the first side frame 102L with overlapping the first side frame 102L when projected in the up-down direction. The right end portion of the main-body coupling 70 protrudes rightward beyond the first guide portion 112L through a corresponding hole 85A of the frame 85.

The main-body electrode 77 is disposed below the second side frame 102R with overlapping the second side frame 102R when projected in the up-down direction. The left end portion of the main-body electrode 77 protrudes leftward beyond the second guide portion 112R through a corresponding hole 86A of the frame 86.

Thereafter, as depicted in FIG. 17, in response to a further tilting of the front cover 8 toward the front to the exposing position, the connecting portion 113A is pulled downward and frontward by an urging force of the tension spring 82. Therefore, the frontmost link member 113 rotates clockwise on its lower end portion in side view.

Thus, the first guide portion 112L and the second guide portion 112R are pulled upward and frontward by the frontmost link member 113 and move upward and frontward in a translation manner.

Therefore, the process cartridge 111 moves upward from the first position to the second position in response to the movement of the first guide portion 112L and the second guide portion 112R.

In response to the upward movement of the process cartridge 111, as depicted in FIG. 18, the photosensitive drum 16 of the process cartridge 111 moves upward to be separated from the intermediate transfer belt 29 such that a uniform spacing is provided in the up-down direction between the photosensitive drum 16 and the intermediate transfer belt 29 across the right-left direction.

Thereafter, the operator moves the support frame 101 supporting the process cartridges 111 frontward from the main body 2 to locate the support frame 101 at the outside position and then pulls the process cartridge 111 upward from the support frame 101 in a similar manner to the first illustrative embodiment.

Therefore, the detachment of the process cartridge 111 from the main body 2 is completed.

In order to attach a process cartridge 111 to the main body 2, the operator operates the printer 110 in a reverse order to the detachment procedure.

More specifically, in a similar manner to the first illustrative embodiment, the operator inserts the process cartridge 111 into a corresponding opening 101A of the support frame 101 and moves the support frame 101 supporting the process cartridges 111 to the inside position. Then, the operator moves the front cover 8 from the exposing position to the closing position.

Then, the first guide portion 112L and the second guide portion 112R move upward and rearward in a translation manner by weight of the process cartridges 111 and the support frame 101.

Thus, as depicted in FIGS. 14 and 15, the drum support portion 49 of the process cartridge 111 comes into engagement with the positioning recess 69A and thus the photosensitive drum 16 of the process cartridge 13 comes into contact with the upper surface of the intermediate transfer belt 29.

Thereafter, in a similar manner to the first illustrative embodiment, in response to the movement of the front cover 8 to the closing position, the translation cam 72 of the driving unit 63 moves to the non-pressing position and the translation cam 76 of the electric supply unit 64 moves to the non-pressing position, the main-body coupling 70 moves to the engaged position, and the main-body electrode 77 moves to the contacting position.

Therefore, the attachment of the process cartridge 111 to the main body 2 is completed.

(4) Effects

According to the second illustrative embodiment, the effects that are the same as the effects obtained in the first illustrative embodiment may be obtained.

9. OTHER VARIATIONS (1) In the above-described illustrative embodiments, the process cartridge 13, 111 as an example of a process cartridge includes the drum unit 14 and the developing unit 15 that are integral with each other. Nevertheless, in other embodiments, for example, another process cartridge including a drum unit including a photosensitive drum and a developing unit detachably attachable to the drum unit may be used as the process cartridge.

(2) In the above-described illustrative embodiments, the first side frame 41L and the second side frame 41R may be made of metal and have a hollow column extending in the sliding direction.

According to the variations, the rigidity of the first side frame 41L and the second side frame 41R may be ensured with the simple configuration.

What is claimed is:

1. An image forming apparatus comprising:

a main body including a first guide portion and a second guide portion;

a process cartridge including a photosensitive drum with an axial direction; and a support frame configured to move between an inside position at which the support frame is located inside of the main body and an outside position at which the support frame is located outside the main body in a sliding direction orthogonal to the axial direction of the photosensitive drum, the support frame extending in an orthogonal direction that is orthogonal to both the axial direction and the sliding direction, and the support frame including:

a first side frame extending in the sliding direction, the first side frame including:

a first guided portion to be guided by the first guide portion when the support frame moves; and a first cartridge-support portion for supporting the process cartridge; and a second side frame spaced apart from the first side frame in the axial direction while extending in the sliding direction, the second side frame including:

a second guided portion guided by the second guide portion when the support frame moves; and a second cartridge-support portion for supporting the process cartridge, wherein a projected plane of the process cartridge projected in the axial direction of the photosensitive drum overlaps a projected plane of the first side frame, wherein the overlap of the projected planes of the process cartridge and first side frame is 30% or less inclusive of a total area of the projected plane of the process cartridge, wherein the projected plane of the process cartridge is an area based on a projection of the process cartridge onto a virtual plane that is perpendicular to the axial direction and the projected plane of the first side frame is an area based on a projection of the first side frame onto the virtual plane, and wherein a dimension in the orthogonal direction of the first side frame and the dimension in the orthogonal direction of the second side frame are each between 10% and 20% inclusive of a dimension in the orthogonal direction of the process cartridge.

2. The image forming apparatus according to claim 1, wherein the area of a part of the projected plane of the process cartridge that overlaps the projected plane of the first side frame is between 5% and 10% inclusive of the total area of the projected plane of the process cartridge.

3. The image forming apparatus according to claim 1, wherein a dimension in the axial direction of the first side frame is greater than or equal to a dimension in the orthogonal direction of the first side frame, and wherein a dimension in the axial direction of the second side frame is greater than or equal to a dimension in the orthogonal direction of the second side frame.

4. The image forming apparatus according to claim 1, wherein the first side frame and the second side frame have a generally rectangular column shape extending in the sliding direction.

5. The image forming apparatus according to claim 1, wherein in a state where the process cartridge is supported by the support frame, the process cartridge includes:

a lower portion supporting the photosensitive drum and positioned below the first side frame and the second side frame; and an upper portion positioned above the first side frame and the second side frame.

6. The image forming apparatus according to claim 5, wherein the process cartridge further includes:

a driving-force receiving member disposed at one end portion of the lower portion in the axial direction and is configured to receive a driving force from the main body; and an electrode member disposed at the other end portion of the lower portion in the axial direction and is configured to receive electric power from the main body.

7. The image forming apparatus according to claim 6, wherein the main body further includes:

a driving-force input member disposed to one side of the lower portion of the process cartridge in the axial direction and configured to move between an engaged position at which the driving-force input member is in engagement with the driving-force receiving member for inputting a driving force to the driving-force receiving member and a disengaged position at which the driving-force input member is not in engagement with the driving-force receiving member; and an electric supply member disposed to the other side of the lower portion of the process cartridge in the axial direction and configured to move between a contacting position at which the electric supply member is in contact with the electrode member for supplying electric power to the electrode member and a non-contacting position at which the electric supply member is not in contact with the electrode member.

8. The image forming apparatus according to claim 7, wherein the driving-force input member includes:

a first end portion disposed at a position farthest from the electric supply member in the axial direction; and a second end portion disposed opposite to the first end portion in the axial direction and at a position nearest to the electric supply member, wherein the second end portion of the driving-force input member is located between the first guide portion and the second guide portion when viewed in the orthogonal direction in a state where the driving-force input member is located at the disengaged position, and overlaps the first side frame when viewed in the orthogonal direction in a state where the support frame is located at the inside position.

9. The image forming apparatus according to claim 7, further comprising a first movable member configured to move between a first position at which the first movable member causes the driving-force input member to be located at the engaged position and a second position at which the first movable member causes the driving-force input member to be located at the disengaged position, and wherein the first movable member overlaps the first side frame when viewed in the orthogonal direction in a state where the support frame is located at the inside position.

10. The image forming apparatus according to claim 7, wherein the electric supply member includes:

a first end portion disposed at a position farthest from the driving-force input member; and a second end portion disposed opposite to the first end portion in the axial direction and at a position nearest to the driving-force input member, wherein the second end portion of the electric supply member is located between the first guide portion and the second guide portion when viewed in the orthogonal direction in a state where the electric supply member is located at the non-contacting position, and overlaps the second side frame when viewed in the orthogonal direction in a state where the support frame is located at the inside position.

11. The image forming apparatus according to claim 7, further comprising a second movable member configured to move between a first position at which the second movable member causes the electric supply member to be located at the contacting position and a second position at which the second movable member causes the electric supply member to be located at the non-contacting position, and wherein the second movable member overlaps the second side frame when viewed in the orthogonal direction in a state where the support frame is located at the inside position.

12. The image forming apparatus according to claim 7, wherein the main body further includes:

a first side plate supporting the driving-force input member; and a second side plate disposed to the other side of the first side plate in the axial direction while being spaced apart from the first side plate in the axial direction, the second side plate supporting the electric supply member, wherein the first guide portion and the second guide portion are disposed between the first side plate and the second side plate.

13. An image forming apparatus comprising:

a main body including a first guide portion and a second guide portion;

a process cartridge including a photosensitive drum with an axial direction; and a support frame configured to move between an inside position at which the support frame is located inside of the main body and an outside position at which the support frame is located outside the main body in a sliding direction orthogonal to the axial direction of the photosensitive drum, the support frame extending in an orthogonal direction that is orthogonal to both the axial direction and the sliding direction, and the support frame including:

a first side frame extending in the sliding direction, the first side frame including:

a first guided portion to be guided by the first guide portion when the support frame moves; and a first cartridge-support portion for supporting the process cartridge; and a second side frame spaced apart from the first side frame in the axial direction while extending in the sliding direction, the second side frame including:

a second guided portion guided by the second guide portion when the support frame moves; and a second cartridge-support portion for supporting the process cartridge, wherein a projected plane of the process cartridge projected in the axial direction of the photosensitive drum overlaps a projected plane of the first side frame, wherein the overlap of the projected planes of the process cartridge and first side frame is 30% or less inclusive of a total area of the projected plane of the process cartridge, wherein the projected plane of the process cartridge is an area based on a projection of the process cartridge onto a virtual plane that is perpendicular to the axial direction and the projected plane of the first side frame is an area based on a projection of the first side frame onto the virtual plane, wherein in a state where the process cartridge is supported by the support frame, the process cartridge includes:

a lower portion supporting the photosensitive drum and positioned below the first side frame and the second side frame; and an upper portion positioned above the first side frame and the second side frame, wherein the process cartridge further includes:

a driving-force receiving member disposed at one end portion of the lower portion in the axial direction and is configured to receive a driving force from the main body; and an electrode member disposed at the other end portion of the lower portion in the axial direction and is configured to receive electric power from the main body, wherein the main body further includes:

a driving-force input member disposed to one side of the lower portion of the process cartridge in the axial direction and configured to move between an engaged position at which the driving-force input member is in engagement with the driving-force receiving member for inputting a driving force to the driving-force receiving member and a disengaged position at which the driving-force input member is not in engagement with the driving-force receiving member;

an electric supply member disposed to the other side of the lower portion of the process cartridge in the axial direction and configured to move between a contacting position at which the electric supply member is in contact with the electrode member for supplying electric power to the electrode member and a non-contacting position at which the electric supply member is not in contact with the electrode member;

a first side plate supporting the driving-force input member;

a second side plate disposed to the other side of the first side plate in the axial direction while being spaced apart from the first side plate in the axial direction, the second side plate supporting the electric supply member; and a power supply board for controlling electric power to be applied to the electric supply member, wherein the power supply board is disposed between the second side plate and the electric supply member in the axial direction, and wherein the first guide portion and the second guide portion are disposed between the first side plate and the second side plate.

14. The image forming apparatus according to claim 1, wherein the process cartridge further includes a driving-force receiving member configured to receive a driving force from the main body, wherein a dimension in the orthogonal direction of the first side frame and a dimension in the orthogonal direction of the second side frame are smaller than a dimension in the orthogonal direction of the driving-force receiving member.

15. The image forming apparatus according to claim 1, wherein the support frame further includes a beam member connecting the first side frame and the second side frame with each other.

16. The image forming apparatus according to claim 15, wherein the first side frame has an engagement hole configured to have the beam member engaged therewith, and wherein the second side frame has another engagement hole configured to have the beam member engaged therewith.

17. The image forming apparatus according to claim 1, wherein the support frame further includes:

a first reinforcing member extending along the first side frame in the sliding direction; and a second reinforcing member extending along the second side frame in the sliding direction.

18. The image forming apparatus according to claim 17, wherein the support frame further includes a beam member connecting the first side frame and the second side frame with each other, wherein the beam member has a cutout configured to have the first reinforcing member engaged therewith and another cutout configured to have the second reinforcing member engaged therewith.

19. The image forming apparatus according to claim 1, wherein when the support frame is located at the inside position, the process cartridge is further configured to move between a first position at which the photosensitive drum is in contact with a transfer medium onto which a developing agent image is to be transferred and a second position at which the photosensitive drum is spaced apart from the transfer medium in the orthogonal direction, wherein the main body further includes a pressing member configured to press the process cartridge toward the first position, wherein the process cartridge further includes a pressed portion pressed by the pressing member, and wherein the pressed portion overlaps the first side frame and the second side frame when viewed in the orthogonal direction.

20. The image forming apparatus according to claim 19, wherein the process cartridge further includes:

a driving-force receiving member configured to receive a driving force from the main body; and an urging member configured to urge the pressed portion such that the process cartridge is retained at the second position in a state where the process cartridge is supported by the support frame, wherein the main body further includes a driving-force input member configured to engage with the driving-force receiving member for inputting the driving force to the driving-force receiving member, and wherein the pressing member does not press the pressed portion in a state where the driving-force input member and the driving-force receiving member are disengaged from each other.

* * * * *